US005449583A

United States Patent [19]

Murofushi et al.

[11] Patent Number: 5,449,583

[45] Date of Patent: Sep. 12, 1995

[54] METHOD OF MAKING DECOLORIZABLE TONER

[75] Inventors: Katsumi Murofushi; Yoshikazu Hosoda, both of Kawasaki; Yuki Abe, Kobe; Kiyotaka Yamaguchi, Kobe; Takayuki Yoshida, Kobe, all of Japan

[73] Assignees: Showa Denko, K.K., Tokyo; Bando Chemical Industries, Ltd., Kobe, both of Japan

[21] Appl. No.: 300,860

[22] Filed: Sep. 6, 1994

Related U.S. Application Data

[62] Division of Ser. No. 974,753, Nov. 13, 1992, Pat. No. 5,362,592.

[30] Foreign Application Priority Data

| | | | |
|---|---|---|---|
| Nov. 14, 1991 | [JP] | Japan | 3-298905 |
| Dec. 21, 1991 | [JP] | Japan | 3-339142 |
| Dec. 27, 1991 | [JP] | Japan | 3-347363 |
| Dec. 27, 1991 | [JP] | Japan | 3-347365 |

[51] Int. Cl.[6] ..... G03G 9/09

[52] U.S. Cl. ..... 430/137

[58] Field of Search ..... 430/106, 137

[56] References Cited

U.S. PATENT DOCUMENTS

| | | | |
|---|---|---|---|
| 4,404,270 | 9/1983 | Higashida et al. | 430/110 |
| 5,045,420 | 9/1991 | Hosono et al. | 430/45 |
| 5,166,041 | 11/1992 | Murofushi et al. | 430/399 |

FOREIGN PATENT DOCUMENTS

| | | | |
|---|---|---|---|
| 379157 | 7/1990 | European Pat. Off. . | |
| 0468465 | 1/1992 | . | |
| 3120542 | 3/1982 | Germany . | |
| 62-28771 | 2/1987 | Japan | 430/110 |
| 1-172973A | 7/1989 | Japan | 430/110 |
| 1-172974A | 7/1989 | Japan | 430/110 |

OTHER PUBLICATIONS

Patent Abstracts of Japan, vol. 9, No. 190, Aug. 7, 1985, "Pulverous Powder for Forming Image".

Patent Abstracts of Japan, vol. 7, No. 206, Sep. 10, 1983, "Image Forming Fine Powder".

Patent Abstracts of Japan, vol. 8, No. 188, Aug. 29, 1984, "Toner for Developing Electrical Latent Image".

Patent Abstracts of Japan, vol. 13, No. 27, Jan. 20, 1989, "Toner Composition ".

*Primary Examiner*—Roland Martin

*Attorney, Agent, or Firm*—Armstrong, Westerman, Hattori, McLeland and Naughton

[57] ABSTRACT

A decolorizable toner including a resin binder, a near infrared ray-absorbing dye, a decolorizing agent and a light fastness stabilizer, and a process for preparing the decolorizable toner, which includes the steps of mixing the near infrared ray-absorbing dye and the light fastness stabilizer with the resin binder, and then mixing the decolorizing agent therewith. The decolorizable toner has excellent light stability during its production or storage and excellent decolorizing property.

1 Claim, No Drawings

METHOD OF MAKING DECOLORIZABLE TONER

This application is a division of application Ser. No. 07,974,753, filed Nov. 13, 1992, now U.S. Pat. No. 5,362,592.

BACKGROUND OF THE INVENTION

The present invention relates to a decolorizable toner, and more particularly to a near infrared ray-decolorizable toner which can make an electric latent image or an electric signal used in electrophotography, electrostatic recording materials and the like visible.

In recent years the reuse or recyle of used papers has been studied in order that forest resources can be protected and that used papers can be diminished from cities. As a part of the reuse or recyle of used papers, the reuse of used papers such as copied paper, printed paper and used facsimile paper which are discarded in an office of enterprise, has been studied.

There is an attempt to join a paper-manufacturing company in one enterprise so that used papers can be reused or recycled by collecting and dissolving the used papers to produce regenerated paper in the paper-manufacturing company. However, since most of these used papers are generally confidential papers of the enterprise, it is very difficult that the used papers are collected to produce paper in regenerated a paper-manufacturing company outside the enterprise. Also, since recorded figures or printed images of the used papers cannot be easily erased, the used papers are required to be burned or crushed for dumping. Therefore, it has been thought that the used papers cannot be probably actually reused. Also, although the recycle of the used papers which are previously crushed by using a paper-shredder has been studied, there is a defect that regenerated paper made of the crushed papers cannot be used as, for instance, specialty papers for communication since the regenerated paper generally has small mechanical strength.

As a toner which overcomes the above problems, we have developed a decolorizable toner containing a near infrared ray-decolorizing recording material which is decomposed and decolorized by absorbing near infrared rays.

When an electrostatic copying is carried out with the decolorizable toner, images or printed figures recorded on a recording paper can be easily decolorized only by the irradiation of near infrared rays, and therefore, the recording paper can be reused. Also, when the used recording paper is disposed, the recorded images or printed figures can be decolorized by the irradiation of near infrared rays, and therefore, there are many advantages such that the collected used recording papers can be reused at the same time that the transpiration of secret matters described in confidential papers can be prevented.

The decolorizable toner, however, has disadvantages in terms of decolorizing of the near infrared ray-decolorizing material when the decolorizable toner is exposed to natural light during the production or storage of the decolorizable toner since the natural light contains a light which denaturalizes the near infrared ray-decolorizing material and a sensitizer for decolorizing the near infrared ray-decolorizing material contained in the above decolorizable toner.

An object of the present invention is to provide a decolorizable toner having excellent light stability during the production or storage of the decolorizable toner, and forming images having excellent light resistance.

A further object of the present invention is to provide a decolorizable toner having excellent decolorizing property.

These and other objects of the present invention will become apparent from the description hereinafter.

SUMMARY OF THE INVENTION

In accordance with the present invention, there are provided (1) a decolorizable toner comprising (A) a resin binder, (B) at least one near infrared ray-absorbing dye selected from the group consisting of a near infrared ray-absorbing dye represented by the general formula (I):

$$X^-.Y^+ \qquad (I)$$

wherein $X^-$ is a halogen ion, perchloric acid ion, $PF_6^-$, $SbF_6^-$, $OH^-$, sulfonic acid ion or $BF_4^-$, $Y^+$ is a cation having absorptions in the near infrared region, and a near infrared ray-absorbing dye represented by the general formula (II):

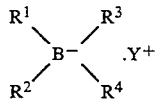

(II)

wherein each of $R^1$, $R^2$, $R^3$ and $R^4$ is independently hydrogen atom, a hydrocarbon group or a hydrocarbon group containing a hetero atom, $Y^+$ is the same as defined above, (C) a decolorizing agent represented by the general formula (III):

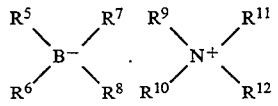

(III)

wherein each of $R^5$, $R^6$, $R^7$ and $R^8$ is independently an alkyl group, an aryl group, an allyl group, an aralkyl group, an alkenyl group, an alkynyl group, silyl group, an alicyclic group, a substituted alkyl group, a substituted aryl group, a substituted allyl group, a substituted aralkyl group, a substituted alkenyl group, a substituted alkynyl group or a substituted silyl group, with the proviso is an that at least one of $R^5$, $R^6$, $R^7$ and $R^8$ is an alkyl group having 1 to 12 carbon atoms; and each of $R^9$, $R^{10}$, $R^{11}$ and $R^{12}$ is independently hydrogen atom, an alkyl group, an aryl group, an allyl group, an aralkyl group, an an alkenyl group, an alkynyl group, an alicyclic group, a substituted alkyl group, a substituted aryl group, a substituted allyl group a substituted aralkyl group, a substituted group alkenyl or a substituted alkynyl group, and (D) a light fastness stabilizer, and (2) a process for preparing a decolorizable toner which comprises the steps of mixing a near infrared ray-absorbing dye and a light fastness stabilizer with a resin binder, and then mixing a decolorizing agent therewith.

DETAILED DESCRIPTION

The decolorizable toner of the present invention is hardly discolored due to the denaturalization of a near infrared ray-absorbing dye contained in the decolorizable toner when the decolorizable toner is exposed to natural light during its production or storage. Therefore, the decolorizable toner shows excellent storage stability. Moreover, the images formed from the decolorizable toner have excellent light resistance.

Typical examples of the resin binder used in the decolorizable toner of the present invention are, for instance, polystyrene resins represented by polystyrene and the like; polyester resins represented by a saturated polyester, an unsaturated polyester and the like; epoxy resins; (meth)acrylic resins represented by polymethyl methacrylate and the like; silicone resins; fluorocarbon resins; polyamide resins; polyvinyl alcohol resins; polyurethane resins; polyolefinic resins; polyvinyl-butyral resins; phenol-formaldehyde resins; rosin-denatured phenol-formaldehyde resins, and the like, and the present invention is not limited to the exemplified ones. These resin binders can be generally used alone or in admixture thereof.

When a resin having a melt viscosity of at most $10^7$ poise at a temperature of 110° C. and a melt viscosity of at least $10^3$ poise at a temperature of 140° C. is used as the resin binder of the decolorizable toner, a printed image and the like, which are formed from the decolorizable toner on a support such as copying paper can be almost completely decolorized by irradiating near infrared rays. Also, after decolorizing, the decolorized printed image is hardly discolored when a visible light is irradiated to the decolorized printed image.

When the printed image formed from the decolorizable toner is decolorized by means of, for instance, a halogen lamp and the like, the decolorizable toner is generally sometimes heated to 110° C. or more. If the interaction of the near infrared ray-absorbing dye and the decolorizing agent is insufficient at that temperature, decolorizing property is not sufficiently imparted to the decolorizable toner. When a resin binder having a maximum specific viscosity of $10^7$ poise at 110° C. is used, since the interaction of the near infrared ray-absorbing dye and the decolorizing agent is maintained by the mobility of the resin binder, the decolorizing property is improved.

The near infrared ray-absorbing dye is generally thermally decomposed at a temperature of around 140° C. and decomposition products generated therefrom deteriorate visible light resistance of the decolorizable toner.

When a resin binder shows a sufficiently high melt viscosity at that temperature, since the near infrared ray-absorbing dye would not move in the resin binder, the near infrared ray-absorbing dye is hardly decomposed by the heat.

Furthermore, if the mobility of the resin binder is remarkably changed by the change of a heating temperature of the resin binder, a problem occurs in forming a figure or an image on a recording paper by using the toner. For instance, when the resin binder has a melt viscosity of less than $10^3$ poise at a temperature of 140° C., the resin binder is completely molten by the heat for fixing the toner on a recording paper, and the interaction between the near infrared ray-absorbing dye and the decolorizing agent is promoted. As a result, the recorded figure or image is discolored when a visible light is irradiated to the figure or image. However, when a resin binder having a melt viscosity of at least $10^3$ poise at a temperature of 140° C. is used, the above phenomenon does not occur and the decolorizable toner shows excellent visible light resistance.

As mentioned above, in the present invention, it is preferred that a resin having a melt viscosity of at most $10^7$ poise at a temperature of 110° C. and a melt viscosity of at least $10^3$ poise at a temperature of 140° C. is used as the resin binder.

The above-mentioned melt viscosity is intended to refer to a value measured by using a Shimadzu Flowtester. More particularly, the above-mentioned melt viscosity is intended to refer to a viscosity which is determined by charging a cylinder equipped with a die having a length of 1 mm and a diameter of 1 mm of Shimadzu Flowtester CFT-500 commercially available from SHIMADZU CORP. with 1.5 g of a resin binder, increasing the temperature of the resin binder at an increasing temperature of 2° C. /minute while applying a pressure of 10 kg.f/cm$^2$ to the binder resin with a plunger, and measuring the viscosity of the binder at a temperature of 110° C. or 140° C.

When the melt viscosity of the resin binder is higher than $10^7$ poise at 110° C., even if the temperature of the toner attains to around 110° C. by the heat from a halogen lamp or the like during the decolorization of the toner, the mobility of the resin binder is small, the contact frequency of the near infrared ray-absorbing dye and the decolorizing agent is lowered, and the improvement decolorizing property cannot be expected. When the melt viscosity of the resin binder is lower than $10^3$ poise at 140° C., as mentioned above, the resin binder of the toner is excessively molten during fixing the toner, and the discolorization of the figure or image formed from the toner is promoted by the irradiation of visible light. Accordingly, in the present invention, it is desired that a resin having a melt viscosity of at most $10^7$ poise, preferably at most $10^6$ poise at a temperature of 110° C. and a melt viscosity of at least $10^3$ poise, preferably at least $5\times10^3$ poise at a temperature of 140° C. is used as the resin binder.

Concrete examples of the resin binder having the above-mentioned melt viscosity are, for instance, homopolymers of styrene or substituted styrenes such as polystyrene, poly-p-chlorostyrene and polyvinyltoluene; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl copolymer, α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic acid ester copolymer; polymethyl methacrylate, polybutyl methacrylate, polyvinyl chloride, polyvinyl acetate, polyethylene, polypropylene, polyester, polyurethane, polyamide, an epoxy resin, polyvinyl butyral, an acrylic acid resin, rosin, denatured rosin, a terpene resin, a phenol resin, an aliphatic or alicyclic hydrocarbon resin, an aromatic petroleum resin, chlorinated paraffin, and the like, and the present invention is not limited to the exemplified ones. These resin binders are generally used alone or in admixture thereof. Among these resin binders, styrene-acrylic acid ester copolymers and polyester can be particularly preferably used since the near infrared ray-absorbing dye and the decoloring agent can be uniformly dispersed in these resins and therefore a decolorizable toner can be easily prepared therefrom, and further the decolorizable toner has excellent decolorizing property and discoloration resistance against visible light.

It is preferred that a thermoplastic resin having a light transmittance of at least 80%, particularly at least 85% is used as a resin binder in order that afterimages are scarcely remained after the decolorization treatment.

In the present specification, the light transmittance is intended to refer to a value measured by a method prescribed in JIS K 6717 Item 4.5 (1977).

In the present invention, the light transmittance was measured by using a direct reading haze meter commercially available from TOYO SEIKI SEISAKU-SYO, LTD.

Concrete examples of the thermoplastic resin are, for instance, polystyrene resins such as styrene homoplymer, hydrogenated polystyrene, a styrene-propylene copolymer, a, styrene-isobutylene copolymer, a styrene-butadiene copolymer, a styrene-allyl alcohol copolymer, a styrene-maleic acid ester copolymer, a styrene-maleic anhydride copolymer, an acrylonitrile-butadiene-styrene terpolymer, an acrylonitrile-styrene-acrylic acid ester terpolymer, a styrene-acrylonitrile copolymer, an acrylonitrile-acrylic rubber-styrene terpolymer and an acrylonitrile-chlorinated polyethylene-styrene terpolymer; acrylic resins such as polymethyl methacrylate, polyethyl methacrylate, polybutyl methacrylate, polyglycidyl methacrylate, a fluorine-containing acrylate-methyl methacrylate-butyl methacrylate copolymer and an ethyl acrylate-acrylic acid copolymer; styrene-(meth)acrylic acid ester copolymers such as a styrene-acrylic acid copolymer, a styrene-butadiene-acrylic acid ester copolymer, a styrene-methyl methacrylate copolymer, a styrene-butyl methacrylate copolymer, a styrene-diethylaminoethyl methacrylate copolymer, a styrene-methyl methacrylate-butyl acrylate terpolymer, a styrene-glycidyl methacrylate copolymer, a styrene-butadiene-dimethylaminoethyl methacrylate terpolymer, a styrene-acrylic acid ester-maleic acid ester terpolymer and a styrene-butyl acrylate-acrylic acid terpolymer, and the like. These resins can be used alone or in admixture thereof.

As the resin binder, a resin binder having a large polarity can be particularly preferably used since excellent discoloration resistance is imparted to a toner. Examples of such resin binder are, for instance, resins having at least one group selected from hydroxyl group, cyano group, carboxyl group, carbonyl group and ketone group in its molecule, such as polyester resins, epoxy resins, (meth)acrylic resins, polyamide resins, polyvinyl alcohol resins, polyurethane resins, polyacrylonitrile resins, polyvinyl acetate resins, phenol resins, styrene-acrylic acid copolymers, styrene-acrylonitrile copolymers, ethylene-vinyl acetate copolymers or ethylene-acrylic acid copolymers.

The amount of the resin binder having a large polarity cannot be absolutely determined since the degree of polarity changes depending upon the kind of the polar group existing in the resin binder, but it is generally preferable that the content of such resin binder in the total amounts of the resin binder is at least 5% by weight, particularly at least 10% by weight in order to sufficiently improve the discoloration resistance.

In the present invention, if necessary, a wax such as a polyolefin wax or a paraffin wax can be added to the resin binder. It is preferable that the amount of the wax is at least 0.1 part (part by weight, hereinafter referred to the same), particularly at least 0.5 part based upon 100 parts of the resin binder from the viewpoint of using sufficiently imparting the effect of the wax to the resin binder. However, when the amount of the wax is excessive, since there is a tendency that a film of the wax is formed on the electric latent image of a photosensitive body, it is preferable that the amount of the wax is at most 20 parts, particularly at most 10 parts based upon 100 parts of the resin binder. Among the waxes, the polyolefin wax is preferable in the present invention.

When a printed image is formed from the decolorizable toner containing the polyolefin wax on a support such as copying paper, rough decolorization is scarcely caused and the printed image can be rapidly and uniformly decolorized, even if the printed image is irradiated with near infrared rays from only one direction.

The reason why the decolorizable toner has such excellent properties is not evident. However, the following reasons can be thought as some parts of reasons.

When the decolorizable toner is fixed on a support, some particles of the wax are existed in the decolorizable toner, and the other particles of the wax are bled out between the particles of decolorizable toner and in the interface of the decolorizable toner and the support and on the outside surface of the decolorizable toner. The near infrared rays can be transmitted to the internal of the fixed decolorized toner owing to specific optical properties such as lens effect (effect such that the wax acts as a lens) and light-diffusing effect. Furthermore, near infrared rays can also be transmitted to the upper surface, side surface and back surface of the near infrared ray-absorbing dye contained in the decolorizable toner owing to the light-reflecting function of the wax. Therefore, even if the decolorizable toner is irradiated with near infrared rays from only one direction, the near infrared rays are diffused in the toner and the near infrared ray-absorbing dye can be rapidly decolorized.

Also, the wax is softened by the irradiation of near infrared rays or heating as a supplementary means, mobility of the near infrared ray-absorbing dye and the decolorizing agent is heightened, and the contact frequency of the near infrared ray-absorbing dye and the decolorizing agent is increased, that is, the wax acts as a lubricant, and the near infrared ray-absorbing dye is sufficiently decolorized.

Accordingly, even if a material through which near infrared rays hardly pass is contained in the decolorizable toner, the near infrared ray-absorbing dye can be uniformly and quickly decolorized.

As a resin binder preferably used in the decolorizable toner, resins having no compatibility with a polyolefin wax are used in order to obtain a sufficient lens effect of the polyolefin wax and the like. Concrete examples of these resin binders are, for instance, represented by polystyrene and the polystyrene resins represented by polyester, and like like, polyester resins represented by polyester, unsaturated polyester and the like, an epoxy resin, (meth)acrylic resins represented by polymethyl methacrylate and the like, a silicone resin, a fluorocarbon resin, polyamide resins, polyvinyl alcohol resins, polyurethane resins, and the like. The present invention is not limited to the exemplified ones. These resin binders are generally used alone or in admixture thereof.

In the present specification, the meaning of the sentence "the polyolefin wax has no compatibility with the resin binder" is intended to refer to that the polyolefin wax and the resin binder exist as a mixture thereof when the polyolefin wax and the resin binder are observed by means of a microscope or the like and a border of the both can be clearly observed. As its example, there can be cited, for instance, such that the border of the polyolefin wax and the resin binder can be dearly observed like a so-called island-in-sea structure in which the resin binder constitutes sea and the polyolefin wax constitutes island, and the like.

In order that the polyolefin wax shows a lens effect in an obtained decolorizable toner, it is necessary that the polyolefin wax be colorless. The term "colorless" means "transparent", "colored transparent" or "white". In the present invention, it is particularly preferable that the wax be transparent. When the polyolefin wax has compatibility with the resin binder, since the polyolefin wax does not show the lens effect in an obtained decolorizable toner, it is necessary that the polyolefin wax has no compatibility with the resin binder.

Typical examples of the polyolefin wax are, for instance, unmodified polyolefin wax, modified polyolefin wax prepared by carring out a block or graft copolymerization of olefin components, and the like.

As the olefin components used in the unmodified polyolefin wax and modified polyolefin wax, any of a homopolymer made of a single olefin monomer and a copolymer made of an olefin monomer and the other monomer copolymerizable with the olefin monomer can be used. As the olefin monomer, for instance, ethylene, propylene, butene-1, pentene-1,3-methyl-1-butene, 3-methyl-2-pentene and the other olefin monomers can be cited. As the other monomers which can be copolymerized with the olefin monomer, for instance, various kinds of monomers such as the other olefin monomer, vinyl ethers such as vinyl methyl ether, vinyl esters such as vinyl acetate, haloolefins such as vinyl fluoride, (meth)acrylic acid esters such as methyl acrylate and methyl methacrylate, acrylic acid derivatives such as acrylonitrile, and organic acids such as acrylic acid can be cited. When the copolymer is used, copolymers such as an ethylene-propylene copolymer, an ethylene-butene copolymer, an ethylene-vinyl acetate copolymer, an ethylene-vinyl methyl ether copolymer and an ethylene-propylene-vinyl acetate copolymer can be cited. When the copolymer is obtained from the monomers other than the olefin monomer, it is preferred that the content of the olefin units derived from the olefin monomer is at least 50% by mole.

As the component for modifying which is contained in the modified polyolefin wax, for instance, aromatic vinyl monomers such as 1-phenylpropene, styrene, methylstyrene, p-ethylstyrene and p-n-butylstyrene; α-methylene aliphatic monocarboxylic acid ester monomers such as methyl acrylate, ethyl acrylate, methyl methacrylate and ethyl methacrylate, and the like can be used. When the aromatic vinyl monomer is used as the component for modifying, it is preferred that its content is 0.1 to 15% by weight, particularly 1 to 10% by weight. Also, when the α-methylene aliphatic monocarboxylic acid ester is used as the component for modifying, it is preferred that its content is 0.1 to 50 by weight, particularly 1 to 40% by weight.

In the present invention, in addition to the above-mentioned ones, there can be used, for instance, a polyethylene wax comprising a copolymer such as a block copolymer of ethylene and methyl methacrylate or butyl methacrylate, a graft copolymer prepared by carrying out a graft polymerization of polyethylene and methyl methacrylate or butyl methacrylate, or a block copolymer of ethylene and styrene, and the like.

It is desired that the polyolefin wax itself has a low softening point. For instance, it is desired that the softening point of the polyolefin wax measured by a ring and ball method prescribed in JIS K-2531 (1960) is 80° to 180° C., particularly 90° to 165° C. When the softening point of the polyolefin wax is lower than the above-mentioned range, there is a tendency that particles of the wax are not remained as particles at the time an obtained decolorizable toner is fixed on a support, and therefore, lens effects cannot be sufficiently obtained. When the softening point is higher than the above-mentioned range, there is a tendency that the wax is hardly molten when the obtained decolorizable toner is fixed on a support, and therefore the wax hardly bleeds out between the particles of the decolorizable toner and in the interface of the decolorizable toner and the support and the like, and near infrared rays cannot be sufficiently transmitted to the inside of the toner.

Also, it is preferred that the melt viscosity of the polyolefin wax, which is measured by using a BL type viscosimeter, is 20 to 6000 centipoise, particularly 50 to 4500 centipoise at 160° C. When the melt viscosity is lower than the above-mentioned range, the wax is not existed in the state of particles at the time an obtained decolorizable toner is fixed on the support, and there is a tendency that lens effects cannot be sufficiently obtained. When the melt viscosity is higher than the above-mentioned range, the wax is hardly bled out between the particles of the decolorizable toner and in the interface of the decolorizable toner and the support and the like at the time an obtained decolorizable toner is fixed on a support, and there is a tendency that near infrared rays cannot be sufficiently transmitted to the inside of the toner.

Concrete examples of the polyolefin wax are, for instance, VISCOL 660P and VISCOL 550P which are commercially available from SANYO CHEMICAL INDUSTRIES, LTD., POLYETHYLENE 6A commercially available from ALLIED CHEMICAL CORP., HI-WAX 400P, HI-WAX 100P, HI-WAX 200P, HI-WAX 320P, HI-WAX 220P, HI-WAX 2203A and HI-WAX 4202E which are commercially available from MITSUI PETROCHEMICAL INDUSTRIES, LTD., HOECHST WAX PE520, HOECHST WAX PE130 and HOECHST WAX PE190 which are commercially available from HOECHST JAPAN LIMITED and the like, and the present invention is not limited to the exemplified ones.

It is preferred that the average particle diameter of the polyolefin wax, which is measured by using a particle diameter NICOMP 270 imported by NOZAKI AND CO., LTD. in accordance with a light scattering method, is 0.5 to 3 μm, particularly 0.8 to 2 μm. When the average particle diameter of the polyolefin wax is smaller than the above-mentioned range, there is a tendency that the effect of bleeding out of the polyolefin wax becomes insufficient. When the average particle diameter of the polyolefin wax is larger than the above-mentioned range, there is a tendency that a polyolefin wax film is formed on an electric latent image of the photosensitive body.

In the present invention, as the near infrared ray-absorbing dye, at least one near infrared ray-absorbing dye selected from the group consisting of a near infrared ray-absorbing dye represented by the general formula (I):

$$X^- \cdot Y^+ \quad (I)$$

wherein $X^-$ is a halogen ion, perchloric acid ion, $PF_6^-$, $SbF_6^-$, $OH^-$, sulfonic acid ion or $BF_4^-$, $Y^+$ is a cation having absorptions in the near infrared region, and a near infrared ray-absorbing dye represented by the general formula (II):

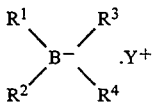

(II)

wherein each of $R^1$, $R^2$, $R^3$ and $R^4$ is independently hydrogen atom, a hydrocarbon group or a hydrocarbon group containing a hetero atom, $Y^{30}$ is the same as defined above, is used.

As the halogen ion, fluorine ion, chlorine ion, bromine ion and iodine ion can be cited. As the sulfonic acid ion, methylsulfonic acid ion such as $CH_3SO_3^-$; substituted methylsulfonic acid ions such as $FCH_2SO_3^-$, $F_2CHSO_3^-$, $F_3CSO_3^-$, $ClCH_2SO_3^-$, $Cl_2CHSO_3^-$, $Cl_3CSO_3^-$, $CH_3OCH_2SO_3^-$ and $(CH_3)_2NCH_2SO_3^-$; phenylsulfonic acid ion such as $C_6H_5SO_3^-$; substituted phenylsulfonic acid ions such as $CH_3C_6H_4SO_3^-$, $(CH_3)_2C_6H_3SO_3^-$, $(CH_3)_3C_6H_2SO_3^-$, $HOC_6H_4SO_3^-$, $(HO)_2C_6H_3SO_3^-$, $(HO)_3C_6H_2SO_3^-$, $CH_3OC_6H_4SO_3^-$, $C_6H_4ClSO_3^-$, $C_6H_3Cl_2SO^-{}_3$, $C_6H_2Cl_3SO_3^-$, $C_6HCl_4SO_3^-$, $C_6Cl_5SO_3^-$, $C_6H_4FSO_3^-$, $C_6H_3F_2SO_3^-$, $C_6H_2F_3SO_3^-$, $C_6HF_4SO_3^-$, $C_6F_5SO_3^-$ and $(CH_3)_2NC_6H_4SO_3^-$, and the like can be cited.

In the general formula (II), as the concrete examples of $R^1$, $R^2$, $R^3$ and $R^4$, there can be cited, for instance, hydrogen atom, an alkyl group, an aryl group, an allyl group, an aralkyl group, an alkenyl group, an alkynyl group, silyl group, a heterocyclic group, a substituted alkyl group, a substituted aryl group, a substituted allyl group, a substituted aralkyl group, a substituted alkenyl group, a substituted alkynyl group, a substituted silyl group and the like. Among them, as the concrete examples of preferable ones, there can be cited, for instance, hydrogen atom, phenyl group, anisyl group, n-butyl group, n-pentyl group, n-hexyl group, n-heptyl group, n-octyl group, n-dodecyl group, cyclohexyl group, cyclohexenyl group, methoxymethyl group, methoxyethyl group, ethoxyphenyl group, toluyl group, t-butylphenyl group, fluorophenyl group, chlorophenyl group, diethylaminophenyl group, vinyl group, allyl group, triphenylsilyl group, dimethylphenylsilyl group, dibutylphenylsilyl group, trimethylsilyl group, piperidyl group, thienyl group, furyl group and the like. It is preferred that at least one $R^1R^2$, $R^3$ and $R^4$ is an alkyl group having 1 to 12 carbon atoms. Among these alkyl groups, alkyl groups having 4 to 12 carbon atoms such as n-butyl group, n-pentyl group, n-hexyl group, n-heptyl group, n-octyl group and n-dodecyl group are particularly preferable.

As the preferable $Y^{30}$ of the near infrared ray-absorbing dye represented by the general formula (I), for instance, cationic dyes of cyanine, triarylmethane, aminium, diimonium, thiazine, xanthene, oxazine, styryl and pyrylium, having absorptions in the near infrared regions, and the like can be preferably used. Typical examples of $Y^{30}$ are, for instance,

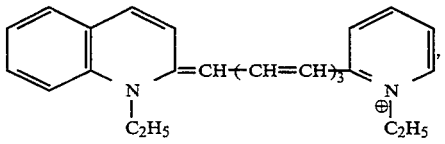

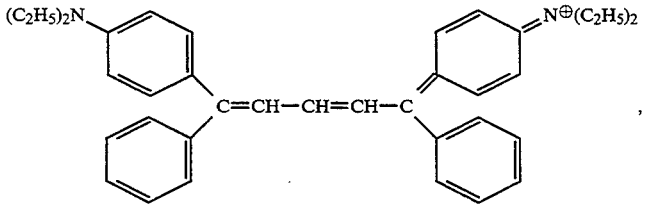

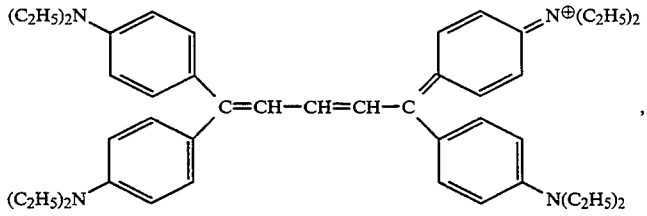

-continued

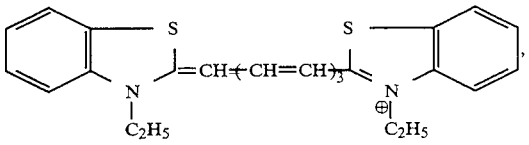

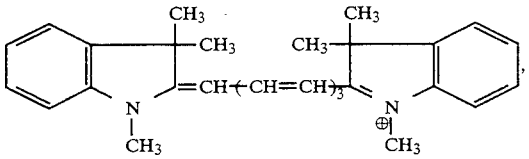

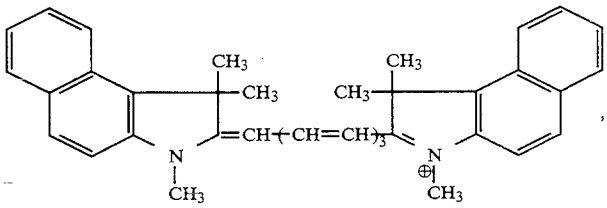

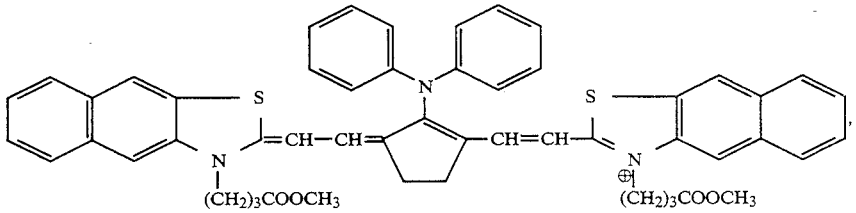

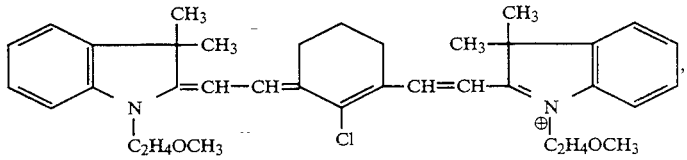

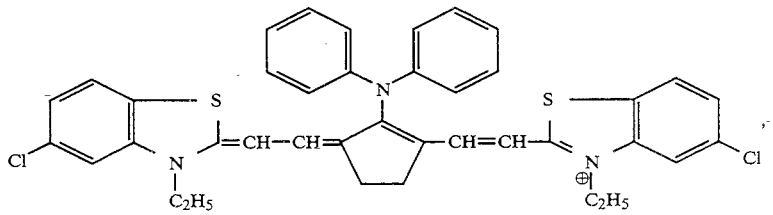

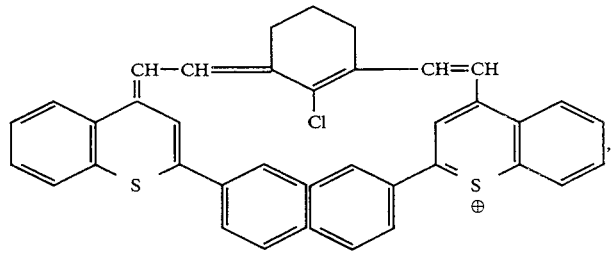

and the like.

The amount of the near infrared ray-absorbing dye is 0.01 to 25 parts, preferably 0.1 to 15 parts based upon 100 parts of the resin binder. When the amount of the near infrared ray-absorbing dye is less than the above-mentioned range, an obtained decolorizable toner cannot be sufficiently colored. When the amount of the near infrared ray-absorbing dye is more than the above-mentioned range, an amount of tribo-electric charge of an obtained decolorizable toner is sometimes impaired.

In the present invention, as the decolorizing agent, a decolorizing agent represented by the general formula (III):

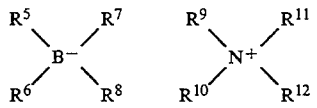

(III)

wherein each of $R^5$, $R^6$, $R^7$ and $R^8$ is independently an alkyl group, an aryl group, an allyl group, an aralkyl group, an alkenyl group, an alkynyl group, silyl group, a heterocyclic group, a substituted alkyl group, a substituted aryl group, substituted allyl group, a substituted aralkyl group, a substituted alkenyl group, a substituted alkynyl group or a substituted silyl group, with the proviso that at least one of $R^5$, $R^6$, $R^7$ and $R^8$ is an alkyl group having 1 to 12 carbon atoms; and each of $R^9$ $R^{10}$, $R^{11}$ and $R^{12}$ is independently hydrogen atom, an alkyl group, an aryl group, an allyl group, an aralkyl group, an alkenyl group, an alkynyl group, a heterocyclic group, a substituted alkyl group, a substituted aryl group, a substituted allyl group, a substituted aralkyl group, a substituted alkenyl group or a substituted alkynyl group, is used.

Concrete examples of the decolorizing agent are, for instance, tetramethylammonium n-butyltriphenylborate, tetramethylammonium n-butyltrianisylborate, tetramethylammonium n-octyltriphenylborate, tetramethylammonium n-octyltrianisylborate, tetraethylammonium n-butyltriphenylborate, tetraethylammonium n-butyltrianisylborate, tetrabutylammonium n-butyltriphenylborate, tetrabutylammonium n-butyltrianisylborate, tetraoctylammonium n-octyltriphenylborate, tetrabutylammonium n-dodecyltriphenylborate, trimethylhydrogenammonium n-butyltriphenylborate, triethylhydrogenammonium n-butyltriphenylborate, tetrahydrogenammonium n-butyltriphenylborate, tetramethylammonium tetrabutylborate, tetraethylammonium tetrabutylborate, tetra-n-butylammonium tetra-n-butylborate, tetramethylammonium tri-n-butyl(triphenylsilyl)borate, tetraethylammomum tri-n-butyl(triphenylsilyl)borate, tetrabutylammonium n-butyl(triphenylsilyl)borate, tetramethylammonium tri-n-butyl(dimethylphenylsilyl)borate, tetraethylammonium tri-n-butyl(dimethylphenylsilyl)borate, tetrabutylammonium tri-n-butyl(dimethylphenylsilyl)borate, tetramethylammonium ammonium n-octyldiphenyl(di-n-butylphenylsilyl)borate, tetraethylammonium n-octyldiphenyl(di-n-butylphenylsilyl)borate, tetrabutylammonium n-octyldiphenyl(di-n-butylphenylsilyl)borate, tetramethylammonium dimethylphenyl(trimethylsilyl)borate, tetraethylammonium dimethylphenyl(trimethylsilyl)borate, tetrabutylammonium dimethylphenyl(trimethylsilyl)borate, and the like, and these decolorizing agents can be used alone or in admixture thereof.

The amount of the decolorizing agent cannot be indiscriminately determined because the amount depends upon the kind of the near infrared ray-absorbing dye, but the amount of the decolorizing agent is usually adjusted within the range of 1 to 2500 parts, preferably 5 to 1000 parts based upon 100 parts of the near infrared ray-absorbing dye. When the amount of the decolorizing agent is less than the above-mentioned range, the speed of decolorization becomes slow. When the amount of the decolorizing agent is more than the above-mentioned range, light stability of a figure or image formed from an obtained decolorizable toner is deteriorated and the color of the figure or image is discolored or faded.

In the present invention, as mentioned above, in order to prevent discoloration of the near infrared ray-absorbing dye contained in the decolorizable toner by the irradiation of natural light, a light fastness stabilizer is used.

As the light fastness stabilizer, for instance, a heat-resistant age resistor, a metal soap or a metal oxide can be used.

As the heat-resistant age resistor, it is desired that a heat-resistant age resistor, which would not stain a support such as paper when the decolorizable toner is transferred to and fixed on the support, is used.

Furthermore, when the decolorizable toner is applied to paper having a whitish color such as copying paper, a heat-resistant age resistor having a white or light color is preferably used.

As the heat-resistant age resistor, a heat-resistant age resistor which scarcely stains a white copying paper and the like can be used. Concrete examples of the heat-resistant age resistor are, for instance, hydroquinone derivative age resistors such as 2,5-di-t-amylhydroquinone, 2,5-di-t-butylhydroquinone and hydroquinone monoethyl ether; alkylated phenol and phenol derivative age resistors such as 1-oxy-3-methyl-4-isopropylbenzene, 2,6-di-t-butylphenol, 2,6-di-t-butyl-4-ethylphenol, 2,6-di-t-butyl-4-methylphenol, 2,6-di-t-butyl-4-sec-butylphenol, butylhydroxyanisole, 2,6-di-t-butyl-α-dimethylamino-p-cresol, 2-(1-methylcyclohexyl)-4,6-dimethylphenol, styrenated phenol, alkylated phenol, bisphenol A, bisphenol S, ethyl p-hydroxybenzoate, n-propyl gallate, lauryl gallate and resorcinol; hindered phenol-age resistors such as 1,1,3-tris-(2-methyl-4-hydroxy-5-t-butylphenyl)butane, 4,4'-butylidene bis-(3-methyl-6-t-butylphenol), 2,2-thiobis(4-methyl-6-t-butylphenol), n-octadecyl-3-(4'-hydroxy-3', 5'-di-t-butylphenyl)propionate; phosphite-age resistors such as tris(nonylphenyl) phosphite, tris(mixed mono and dinonylphenyl) phosphite, phenyldiisodecyl phosphite, diphenylmono(2-ethylhexyl) phosphite, diphenylmonotridecyl phosphite, diphenylisodecyl phosphite, diphenylisooctyl phosphite, diphenylphenyl phosphite, triphenyl phosphite, tris(tridecyl) phosphite and tetraphenyldipropylene glycol phosphite, and the like. These heat-resistant age resistors can be used alone or in admixture thereof. Among these heat-resistant age resistors, the hydroquinone derivative and phenol derivative are preferable since they are excellent in compatibility with the styrenic resin binder and can remarkably prevent the deterioration of properties of a crystalline resin due to light.

The amount of the heat-resistant age resistor is 0.05 to 30 parts, preferably 0.5 to 10 parts, particularly preferably 0.5 to 2 parts based upon 100 parts of the resin binder. When the mount of the heat-resistant age resistor is less than the above-mentioned range, discoloration of tile near infrared ray-absorbing dye cannot be sufficiently prevented. When the amount of the heat-resistant age resistor is more than the above-mentioned range, cost increases in accordance with the increase of the amount of the heat-resistant age resistor, and also the decolorizable toner cannot be sufficiently colored by the near infrared ray-absorbing dye.

In the present invention, in order to prevent the discoloration, change of color or fading of the near infrared ray-absorbing dye, as the light fastness stabilizer, a metal oxide or a metal soap can also be contained in the decolorizable toner.

The reason why the metal oxide and metal soap impart discoloration resistance is not clear, but it is thought that the discoloration resistance probably results from that the metal oxide has a basic polar group on its surface and the metal soap has an ionic polar group such as carboxyl group. That is, it is thought that since the near infrared ray-absorbing dye is an ionic complex, an ion pair of the complex is stable when an anionic polar group exists, and therefore, the stability of the dye to the light and heat is improved. Accordingly, it is thought that when the above-mentioned metal oxide or metal soap exists together with the near infrared ray-absorbing dye, the near infrared ray-absorbing dye is stabilized, and the discoloration, change of color and fading are prevented.

Concrete examples of the metal oxide are, for instance, $MgO$, $Al_2O_3$, $SiO_2$, $Na_2O$, $SiO_2.MgO$, $SiO_2.Al_2O_3$, $Al_2O_3.Na_2O.CO_2$, $MgO.Al_2O_3.CO_2$ and the like. These metal oxides can be used alone or in admixture thereof. Among these metal oxides, $MgO$, a mixture of $MgO$ and $SiO_2$ or $Al_2O_3$, $Na_2O$, $SiO_2.MgO$, $SiO_2.Al_2O_3$, $Al_2O_3$, $Na_2O.CO_2$, $MgO.Al_2O_3.CO_2$ and the like are preferable.

When the metal oxide is used as a light fastness stabilizer, it is preferred that the amount of the metal oxide is 1 to 50 parts, particularly 5 to 20 parts based upon 100 parts of the resin binder. When the amount of the metal oxide is more than the above-mentioned range, there is a tendency that the color of an obtained toner is shaded by the color of the metal oxide. When the amount of the metal oxide is less than the above-mentioned range, there is a tendency that a sufficient effect for preventing discoloration cannot be obtained.

When the amount of the metal oxide is at least 5 parts based upon 100 parts of the resin binder, in case an image is formed from the decolorizable toner of the present invention on a white copying paper which is usually used in electrophotography, and then the image is decolorized by the irradiation of near infrared rays, the decolorized portion of the image shows the same white color and gloss as the copying paper because the gloss of resin binder is lowered. Therefore, there is an advantage that the image-formed portions are hardly distinguished from the other portions after decolorizing. Such advantage is particularly noticeable when a metal oxide containing $MgO$ is used among the light fastness stabilizers. Also, $MgO$, the metal oxide containing the $MgO$ and a mixture thereof can be particularly preferably used in the present invention since the coloring of the dye is not hindered by them when an image is formed.

When the average particle diameter of the metal oxide is too large, since quality of the image is sometimes impaired, it is usually preferred that the average particle diameter of the metal oxide is at most 5 $\mu$m, particularly at most 1 $\mu$m. The shape and color of the particle are not particularly limited. However, in order to lower the gloss of the resin binder and traces which are formed by decolorizing the formed figure or image, it is preferable that the particle has a spherical or ellipsoidal shape, and that the color of the particle is white since the color of copying paper for electrophotography is generally white.

Concrete examples of the metal soap are, for instance, salts of stearic acid such as lithium stearate, magnesium stearate, aluminum stearate, calcium stearate, strontium stearate, barium stearate, zinc stearate, cadmium stearate and lead stearate; salts of lauric acid such as cadmium laurate, zinc laurate, calcium laurate and barium laurate; salts of chlorostearic acid such as calcium chlorostearate, barium chlorostearate and cadmium chlorostearate; salts of 2-ethylhexanoic acid such as barium 2-ethylhexanoate, zinc 2-ethylhexanoate, cadmium 2-ethylhexanoate and lead 2-ethylhexanoate; salts of ricinolic acid such as barium ricinoleate, zinc ricinoleate and cadmium ricinoleate; a dibasic lead salt of stearic acid such as $2PbO.Pb(C_{17}H_{35}COO)_2$; salts of salicylic acid such as lead salicylate, zinc salicylate, tin salicylate and chromium salicylate; a tribasic lead salt of maleic acid such as $3PbO.Pb(C_4H_2O_4)H_2O$; a dibasic lead salt of phthalic acid such as $2PbO.Pb(C_8H_4O_4)$, and the like. These metal soaps can be used alone or in admixture thereof. Among these metal soaps, zinc stearate, zinc laurate, lead salicylate, zinc ricinolate, barium 2-ethylhexylate, calcium stearate, magnesium stearate, calcium laurate, and the like are preferable because they have a melting point which is suitable for the toner and are not toxic. When the metal soap is used as the light fastness stabilizer, it is preferred that the amount of the metal soap is 0.05 to 10 parts, particularly 0.1 to 5 parts based upon 100 parts of the resin binder. When the amount of the metal soap is more than the above-mentioned range, there are tendencies that the amount of tribo-electric charge of the decolorizable toner is impaired, that wrong effects such that the metal soap adheres to a photosensitive body and the like are exhibited and that the photosensitive body are stained by the metal soap due to the bleeding out of the decolorizable toner to the surface, and as a result, defects of a formed image are generated. When the amount of the metal soap is less than the above-mentioned range, there is a tendency that discoloration resistance and stability of images are not sufficiently improved.

In the present invention, in order to prevent the yellowing of the resin binder contained in the decolorizable toner, an ultraviolet adsorbing agent can be used. As the ultraviolet adsorbing agent, an ultraviolet adsorbing agent which can effectively absorb ultraviolet rays having a wavelength of 300 to 370 nm or so, which would easily yellow the resin binder, is preferably used. Concrete examples of the ultraviolet adsorbing agent are, for instance, benzophenone-ultraviolet adsorbing agents such as 2,4-dihydroxybenzophenone, 2-hydroxy-4-methoxybenzophenone, 2-hydroxy-4-octyloxybenzophenone, 2-hydroxy-4-dodecyloxybenzophenone, 2,2'-dihydroxy-4-methoxybenzophenone and 2,2'-dihydroxy-4,4'-dimethoxybenzophenone; salicylic acid ester-ultraviolet adsorbing agents such as phenyl salicylate, p-t-butylphenyl salicylate and p-octylphenyl salicylate; benzotriazole-ultraviolet adsorbing agents such as 2-(2'-hydroxy-5'-methylphenyl)benzotriazole, 2-(2'-hydroxy-5'-t-butylphenyl)benzotriazole, 2-(2'-hydroxy-3',5'-di-t-butylphenyl)benzotriazole, 2-(2'-hydroxy-3'-t-butyl-5'-methylphenyl)-5-chlorobenzotriazole, 2-(2'-hydroxy-3',5'-di-t-butylphenyl)-5-chlorobenzotriazole and 2-[2'-hydroxy-3'-(3'',4'',5'',6''-tetrahydrophthalimidomethyl)-5'-methylphenyl]benzotriazole; a hindered amine-ultraviolet adsorbing agents such as bis(2,2,6,6-tetramethyl-4-piperidyl) sebacate, and the like. The present invention is not limited to these exemplified ones. These ultraviolet adsorbing agents can be generally used alone or in admixture thereof.

It is preferred that the amount of the ultraviolet adsorbing agent is 0.2 to 30 parts, particularly 0.5 to 5 parts based upon 100 parts of the resin binder. When the amount of the ultraviolet adsorbing agent is less than the above-mentioned range, there is a tendency that effects exhibited by using the ultraviolet adsorbing agent are not sufficiently obtained. When the amount of the ultraviolet adsorbing agent is more than the above-mentioned range, further improvements exhibited by using the ultraviolet adsorbing agent are scarcely expected and there is a tendency that cost increases.

If necessary, an adequate amount of additives such as a magnetic powder, a fluidizing agent, a plasticizer, a color pigment or a near infrared ray-reflecting or-absorbing material can be contained in the decolorizable toner of the present invention.

As the processes for preparing the decolorizable toner of the present invention, a solution process and a melting process can be employed.

The solution process is a process comprising dissolving a near infrared ray-absorbing dye and a resin binder in an organic solvent, mixing them, adding a decolorizing agent and a light fastness stabilizer, and if necessary, adding an ultraviolet adsorbing agent, a wax or other additives thereto, dissolving and mixing them, removing the organic solvent from the obtained mixture, then, coarsely pulverizing the mixture by using a hammer mill, cutter mill or the like and then finely pulverizing by using a jet mill or the like to give a decolorizable toner having an average particle diameter of 5 to 30 μm or so.

The melting process is a process comprising heating to melt and kneading a near infrared ray-absorbing dye and a resin binder, adding a decolorizing agent and a light fastness stabilizer, and if necessary, adding a wax, an ultraviolet absorbing agent, and other additives thereto, kneading them, cooling the obtained mixture, and then finely pulverizing the mixture in the same manner as the solution process to give a decolorizable toner.

In order to obtain a decolorizable toner which is not discolored or yellowed and has excellent offset resistance without the influence of heat history on the near infrared ray-absorbing dye during melting and kneading the near infrared ray-absorbing dye and the resin binder, it is preferred that the near infrared ray-absorbing dye and a resin binder A having a softening point (a softening point according to a ring and ball method, hereinafter referred to the same)of at least 30° C. lower than the decomposition temperature of the near infrared ray-absorbing dye are heated between at least softening point of the resin binder A and at least 10° C. lower than the decomposition temperature of the near infrared ray-absorbing dye, molten and kneaded them, and to the obtained molten kneaded mixture is added a resin binder B having a softening point of at least 10° C. higher than the softening point of the resin binder A and lower than the decomposition temperature of the near infrared ray-absorbing dye, and then the mixture is heated, molten and kneaded for a short period of time.

In the process for preparing the decolorizable toner of the present invention, at first, the near infrared ray-absorbing dye and the resin binder A having a softening point of at least 30° C. lower than the decomposition temperature of the near infrared ray-absorbing dye are molten and kneaded.

Concrete examples of the resin binder A are, for instance, styrene resins such as polystyrene, poly-p-chlorostyrene, polyvinyltoluene, a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic acid ester copolymer; resins such as polymethyl methacrylate, polybutyl methacrylate, polyvinyl chloride, polyvinyl acetate, polyethylene, polypropylene, polyester, polyurethane, polyamide, art epoxy resin, polyvinyl butyral, an acrylic acid resin, rosin, denatured rosin, a terpene resin, a phenol resin, a chlorinated paraffin and a paraffin wax, which have softening points of at least 30° C. lower than the decomposition temperature of the near infrared ray-absorbing dye. These resin binders A can be generally used alone or in admixture thereof.

There is a necessity that the softening point of the resin binder A is at least 30° C. lower than the decomposition temperature of the near infrared ray-absorbing dye. When the resin binder A does not have the softening point of at least 30° C. lower than the decomposition temperature of the near infrared ray-absorbing dye, since the softening point of the resin binder A is close to the decomposition temperature of the near infrared ray-absorbing dye, the near infrared ray-absorbing dye is badly influenced by its heat history when the resin binder A and the near infrared ray-absorbing dye are molten and kneaded, and thereby properties of the near infrared ray-absorbing dye is deteriorated or the dye is decomposed. It is preferred that the softening point of the resin binder A is at least 40° C. lower than the decomposition temperature of the near infrared ray-absorbing dye.

The ratio of the resin binder A and the near infrared ray-absorbing dye is determined in accordance with the ratio of the resin binder A and the resin binder B and the amount of the near infrared ray-absorbing dye against the total amount of the resin binder A and resin binder B.

In the present invention, it is preferred that the decoloring agent is previously mixed with the resin binder A and near infrared ray-absorbing dye when the resin binder B is not used, but the resin binder A and the near infrared ray-absorbing dye are molten and kneaded, from the viewpoint of increasing the contact frequency of the near infrared ray-absorbing dye and the decolorizing agent and sufficiently improving the decolorizing property during the irradiation of near infrared rays.

Since the amount of the decoloring agent depends upon kinds of the near infrared ray-absorbing dye, the amount of the decolorizing agent cannot be absolutely determined. However, as mentioned above, the amount of the decolorizing agent is generally adjusted within the range of 1 to 2500 parts, preferably 5 to 1000 parts based upon 100 parts of the near infrared ray-absorbing dye.

When the resin binder A and the near infrared ray-absorbing dye are molten and kneaded, the heating temperature is adjusted to at least the softening point of the resin binder A and at least 10° C. lower than the decomposition temperature of the near infrared ray-absorbing dye. When the heating temperature is lower than the softening point of the resin binder A, the resin binder A and the near infrared ray-absorbing dye cannot be uniformly mixed. When the heating temperature is not at least 10° C. lower than the decomposition temperature of the near infrared ray-absorbing dye, the near infrared ray-absorbing dye is discolorized and its properties deteriorate. It is preferable that the upper limit of the heating temperature is at most a temperature which is 70° C. higher, particularly 30° C. higher than the softening point of the resin binder A from the viewpoint of the dispersibility of the near infrared ray-absorbing dye with the resin binder A.

After melting and kneading the near infrared ray-absorbing dye and the resin binder A, the resin binder B is added to the obtained molten kneaded mixture. When the resin binder B is added to the molten kneaded mixture which is in the state of melting, it is difficult that the molten kneaded mixture and the resin binder B are uniformly kneaded for a short period of time. Therefore, in the present invention, it is preferred that the molten kneaded mixture is cooled and then pulverized, and the resin binder B is blended with the pulverized mixture, heated to melt and kneaded, or that the resin binder B is previously molten, and the molten kneaded mixture is added thereto and kneaded.

When the molten kneaded mixture is cooled and pulverized, it is preferred that the particle diameter of the obtained pulverized mixture is adjusted to at most 5 mm or so from the viewpoint of uniformly dispersing the particles in the resin binder B.

It is preferred that the ratio of the resin binder A and the resin binder B, that is, the weight ratio of the resin binder A/the resin binder B is 10/90 to 90/10, particularly 30/70 to 70/30. When this ratio is smaller than the above-mentioned range, dispersibility of the near infrared ray-absorbing dye with the resin binder B is lowered. When the ratio is exceeds the above-mentioned range, offset resistance of an obtained decolorizable toner is lowered.

As mentioned above, it is preferred that the amount of the near infrared ray-absorbing dye is adjusted to 0.01 to 25 parts, particularly 0.1 to 15 parts based upon 100 parts of the total amount of the resin binder A and the resin binder B. When the mount of the near infrared ray-absorbing dye is smaller than the above-mentioned range, there is a tendency that coloring property based upon the near infrared ray-absorbing dye becomes insufficient. When the amount of the near infrared ray-absorbing dye exceeds the above-mentioned range, there is a tendency that dispersibility of the near infrared ray-absorbing dye with the resin binders A and B is lowered.

As the resin binder B, resins which can be used as the resin binder A are exemplified. Among these resins, a resin having a softening point of at least 10 ° C. higher than the softening point of the resin binder A and lower than the decomposition temperature of the near infrared ray-absorbing dye can be used. When the resin binder B does not have a softening point of at least 10° C. higher than the softening point of the resin binder A, there is a tendency that offset resistance becomes insufficient. When the softening point of the resin binder B is at least the decomposition temperature of the near infrared ray-absorbing dye, the near infrared ray-absorbing dye comes to be decomposed, and the decolorizable toner is not sufficiently colored by the and is discolored.

When the molten kneaded, mixture and the resin binder B are molten kneaded and the temperature of its mixture is adjusted within a range of at least the softening point of the resin binder B and lower than the decomposition temperature of the near infrared ray-absorbing dye. It is preferred that the above-mentioned temperature is at most a temperature of 50° C. higher, particularly 30° C. higher than the softening point of the resin binder B from the viewpoint of uniformly dispersing the molten kneaded mixture in the resin binder B.

After the temperature of the mixture of the molten kneaded mixture and the resin binder B is attained to the softening point of the resin binder B, it is desired that a period of time for melting and kneading the molten kneaded mixture and the resin binder B is as short as possible, and is generally within 5 minutes, preferably within 3 minutes, more preferably within 1 minute from the viewpoint of preventing the decomposition and deterioration of the near infrared ray-absorbing dye.

As mentioned above, since there is a necessity that the molten kneaded mixture is uniformly dispersed in the resin binder B for a short period of time, it is preferred that means for kneading such as a pressure are kneader, an extruder or a roll is used when they are kneaded.

After kneading of the molten kneaded mixture and the resin binder B, the mixture is usually allowed to cool or cooled by using a suitable cooling means to a temperature at which a molten material is not existed, usually to room temperature. After the cooled mixture is coasely pulverized by a hammer mill, a cutter mill or the like, the pulverized mixture is further pulverized by, for instance, a jet mill or the like, and then classified by using a wind-force classifier or the like to obtain a decolorizable toner having a desired average particle diameter of, for instance, 12 μm or so.

The thus obtained decolorizable toner containing the near infrared ray-absorbing dye has excellent coloring property, excellent offset resistance, excellent discoloration resistance, excellent blocking resistance and the like since the near infrared ray-absorbing dye is not influenced in its heat history.

In case that a process for producing a decolorizable toner, comprising using a master batch containing a resin binder and a near infrared ray-absorbing dye and a component for decolorizing containing the decolorizing agent is employed as a process for producing the decolorizable toner of the present invention, there can be eliminated the problems such that when the resin binder, the near infrared ray-absorbing dye and the decolorizing agent are heated and molten at a time the near infrared ray-absorbing dye is contacted with the decolorizing agent, and thereby the near infrared ray-absorbing dye is decolorized or discolored.

As mentioned above, since the decolorizing agent is not contained in the master batch, the master batch itself is excellent in light stability and shows excellent discoloration resistance for a long period of time.

The resin binder and the near infrared ray-absorbing dye and if necessary, a light fastness stabilizer are contained in the master batch.

In the master batch, the aforementioned resin binder, the aforementioned near infrared ray-absorbing dye and the aforementioned light fastness stabilizer can be used.

It is preferred that the amount of the near infrared ray-absorbing dye is at most 300 parts, particularly at most 200 parts based upon 100 parts of the resin binder used in the master batch. When the amount of the near infrared ray-absorbing dye is excessive, there is a tendency that it is difficult that the near infrared ray-absorbing dye is uniformly dispersed in the resin binder.

As the processes for preparing the master batch, a solution process and a melting process can be cited.

The solution process comprises the steps of mixing a first solution obtained by dissolving a resin binder in an organic solvent with a second solution obtained by dissolving or dispersing a near infrared ray-absorbing dye, a light fastness stabilizer and if necessary a dispersant in the organic solvent or water, removing the organic solvent or water under a reduced pressure give a mass of the mixture, and pulverizing the mass by using a ball mill or the like to give a master batch.

Concrete examples of the organic solvent are, for instance, alcohols such as ethanol and isopropanol; ketones such as acetone and methyl ethyl ketone; ethers such as diethyl ether, veratrole and tetrahydrofuran; phenols such as phenol and cresol; other aromatic solvents such as benzene, bromobenzene and toluene; halogenated hydrocarbon solvents such as dichloromethane and carbon tetrachloride; aqueous solvents such as water and aqueous solution of ethanol, and the like. The organic solvent used in the first solution can be the same as or different from the organic solvent used in the second solution.

In the first solution, it is preferable that the amount of the organic solvent is 50 to 800 parts, particularly 100 to 500 parts based upon 100 parts of the resin binder. When the amount of the organic solvent is less than the above-mentioned range, there is a tendency that the resin binder is not sometimes sufficiently dissolved in the solvent. When the amount of the organic solvent is more than the above-mentioned range, there is a tendency that excessive cost is sometimes necessitated for removing the organic solvent and water.

In the second solution, it is preferable that the amount of the organic solvent is 10 to 5000 parts, particularly 20 to 3000 parts based upon 100 parts of the near infrared ray-absorbing dye. When the amount of the organic solvent is less than the above-mentioned range, there is a tendency that the near infrared ray-absorbing dye and the resin binder cannot be sometimes sufficiently dissolved in the solvent. When the amount of the organic solvent is more than the above-mentioned range, there is a tendency that excessive cost is sometimes necessitated for removing the organic solvent and water. In the second solution, there is no necessity that the near infrared ray-absorbing dye or the light fastness stabilizer is dissolved in the organic solvent. If necessary, the near infrared ray-absorbing dye and the light fastness stabilizer can be dispersed in the organic solvent or water in a pulverized state.

The above-mentioned melting process comprises heating to melt and kneading a resin binder, a near infrared ray-absorbing dye, and a light fastness stabilizer by using a kneading machine such as a biaxial screw extruder and a kneader to obtain a master batch, or cooling the obtained kneaded mixture, then pulverizing the mixture in the same manner as in the above-mentioned solution process to give a master batch.

The decolorizable toner contains the master batch and a decolorizing agent, if necessary, a resin binder, a wax and a component for decolorizing containing a white filler.

It is preferable that the amount of the resin binder used in the component for decolorizing is at least 50 parts, particularly at least 100 parts based upon 100 parts of the decolorizing agent.

Concrete examples of the white filler are, for instance, titanium oxide, calcium carbonate, alumina, zinc flower, magnesium oxide, magnesium hydroxide, clay, fine powder of silica, and the like. These white fillers can be used alone or in admixture thereof. Among these white fillers, titanium oxide, calcium carbonate, zinc flower and the like are preferable because these are excellent in coloring property.

It is desired that the amount of the white filler is at least 0.5 part, preferably at least 2 parts based upon 100 parts of the resin binder for the master batch and the component for decolorizing in order to sufficiently impart the effect exhibited by using the white filler. When the amount is of the white filler is too much, there is a tendency that the color of the toner is faded. Therefore, it is desired that the amount of the white filler is at most 50 parts, preferably at most 30 parts based upon 100 parts of the resin binder for the master batch and the component for decolorizing.

Also, in consideration of the dispersibility of the components of the master batch and the component for decolorizing, it is desired that the amount of the component for decolorizing is 10 to 3000 parts, preferably 30 to 2500 parts based upon 100 parts of the master batch. When the amount of the component for decolorizing is less than the above range, there is a tendency that the component for decolorizing is not uniformly dispersed in the master batch. When the amount of the component for decolorizing exceeds the above range, there is a tendency that the components of the master batch are not uniformly dispersed in the component for decolorizing.

The decolorizable toner in which the master batch is used is obtained by blending the master batch with the component for decolorizing, heating to melt and kneading them and cooling, and after that, coarsely pulverizing an obtained mass and further finely pulverizing the mass with, for instance, a jet mill to give toner particles having an average particle diameter of 5 to 30 $\mu$m or so and, if necessary, classifying.

As mentioned above, since the decolorizing agent which promotes the discoloration of a near infrared ray-absorbing dye is not contained in the master batch, the near infrared ray-absorbing dye is not discolored, and the master batch shows excellent thermal stability. Also, even though the master batch is irradiated with natural light during the storage of the master batch, the discoloration of the master batch can be prevented and therefore, the master batch shows excellent storage stability. When a light fastness stabilizer is contained in the master batch, the thermal stability and storage stability of the master batch are more improved.

When the decolorizable toner having a sufficient amount of tribo-electric charge suitable for a developer of electrophotography is obtained, an electric charge regulator or an electrically chargeable fine particle can be coated to the surface of a particle for the decolorizable toner.

As a method for coating the electric charge regulator or the electrically chargeable fine particle on the surface of the particle for a decolorizable toner, dry-coating methods using a mechanochemical reaction such as a high speed impact treatment method using a HYBRIDIZATION SYSTEM commercially available from NARA MACHINERY CO., LTD., a fluidized-heatflow treatment method using, for instance, a NEW MALMELIZER commercially available from DALTON CORPORATION, a SURFUSING SYS- TEM commercially available from NIPPON PNEUMATIC MEG. CO., LTD. or the like, a mechanochemical surface fusing method using, for instance, a MECHANOFUSING SYSTEM commercially available from HOSOKAWA MICRON CORPORATION or the like, and a treating method using a powder mixing machine such as a super mixer; a spray coating method using, for instance, a COATMIZER JETCOATING SYSTEM commercially available from FREUND INDUSTRIES CO., LTD. or the like; wet-coating methods such as a spray drying method using a GRANULEX commercially available from FREUND INDUSTRIES CO., LTD. or the like, a fluidized-bed drycoating method using a DISPACOAT commercially available from NISSHIN ENGINEERING CO., LTD. or the like, a method using a spray dryer, a method using a FLOW COATER commercially available from FREUND INDUSTRIES CO., LTD., and a method using a fluidized-bed dryer; and the like are cited, but the prevent invention is not limited to the exemplified ones. Among these methods, the high speed impact treatment method is particularly preferable.

Usually, the amount of the electric charge regulator or electrically chargeable fine particle which is coated on the particle for a decolorizable toner is adjusted so that the amount of the tribo-electric charge (absolute value) of the particle for a decolorizable toner is 10 to 40 $\mu$C/g, particularly 15 to 30 $\mu$C/g. The amount of the electric charge regulator which is coated on the particle for a decolorizable toner is generally 0.1 to 10.0 parts, particularly 0.5 to 5 parts based upon 100 parts of the particle for decolorizable toner. The amount of the electrically chargeable fine particle is 1 to 50 parts, particularly 5 to 30 parts based upon 100 parts of the particle for a decolorizable toner.

As the electric charge regulator, a positively chargeable electric charge regulator and a negatively chargeable electric charge regulator can be used. These electric charge regulators can be generally used alone or in admixture thereof.

Concrete examples of the positively chargeable electric charge regulator are, for instance, an electric charge regulator represented by the general formula (IV):

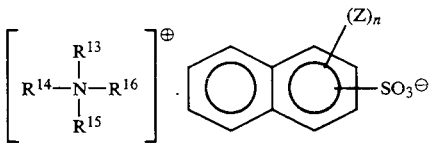

(IV)

wherein $R^{13}$ is an alkyl group having 1 to 8 carbon atoms or benzyl group, each of $R^{14}$ and $R^{15}$ is independently an alkyl group having 1 to 18 carbon atoms, $R^{16}$ is an alkyl group having 1 to 18 carbon atoms or benzyl group, Z is hydroxyl group or amino group, n is 1 or 2; an electric charge regulator represented by the general formula (V):

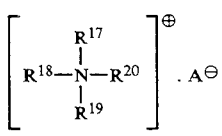

(V)

wherein each of $R^{17}$, $R^{18}$, $R^{19}$and $R^{2°}$ is independently hydrogen atom, an alkyl group having 1 to 22 carbon atoms or an aralkyl group having 9 to 20 carbon atoms, A is a heteropoly-acidion; styrene-acrylic acid quaternary ammonium salt resins, and the like. Typical examples of these positively chargeable electric charge regulators are, for instance, BONTRON P-51 commercially available from ORIENT CHEMICAL INDUSTRIES, LTD., TP-415 commercially available from HODOGAYA CHEMICAL CO., LTD., FUJIKURA FCA-201PB commercially available from FUJIKURA KASEI CO., LTD., and the like.

Concrete examples of the negatively chargeable electric charge regulator are, for instance, an electric charge regulator represented by the general formula (VI):

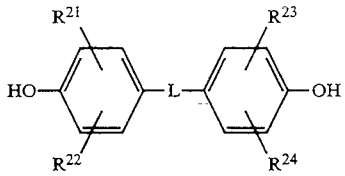

(VI)

wherein each of $R^{21}$, $R^{22}$, $R^{23}$ and $R^{24}$is independently hydrogen atom, an alkyl group having 1 to 8 carbon atoms, an allyl group or a halogen atom, L is —S—, —$SO_2$— or —$C(R^{25})(R^{26})$— wherein each of $R^{25}$ and $R^{26}$ is independently hydrogen atom or an alkyl group having 1 to 8 carbon atoms; styrene-sulfonic acid salt resins, and the like. Typical examples of these negatively chargeable electric charge regulators are, for instance, KAYACHARGE N-1 commercially available from NIPPON KAYAKU CO., LTD., FUJIKURA FCA-1001N commercially available from FUJIKURA KASEI CO., LTD., and the like.

The color of the above-mentioned electric charge regulator is not particularly limited, but it is preferred that the electric charge regulator is transparent, white or faintly yellow so that the color of the decolorizable toner can be the same as the color of paper for electrophotography, which usually white, and that traces of the decolorizable toner can be inconspicuous.

Concrete examples of the electrically chargeable fine particle are, for instance, fine particles of poly(meth)acrylic acid ester such as a fine particle of polymethyl methacrylate, a fine particle of polymethyl acrylate and a fine particle of poly-2-ethylhexyl acrylate; electrically chargeable organic fine particles such as a fine particle of polystyrene and a fine particle of polyvinylidene fluoride; and electrically chargeable inorganic fine particles such as a fine particle of colloidal silica, a fine particle of titanium dioxide, a fine particle of molybdenum sulfide and a fine particle of high purity silica. These fine particles are used alone or in admixture thereof.

When the particle diameter of the above-mentioned electrically chargeable fine particle is excessively larger than the particle diameter of the particle of the decolorizable toner, there is a tendency that the electrically chargeable fine particle is hardly held on the surface of the particle of the decolorizable toner. Accordingly, it is generally preferred that the particle diameter of the electrically chargeable fine particle is at most about 10%, particularly at most about 5% of the particle diameter of the decolorizable toner.

After the thus obtained decolorizable toner of the present invention is printed and fixed on a support made of paper or the like, the printed portion can be decolorized by irradiating near infrared rays by using a semiconductor laser, a halogen lamp or a light emitting diode. After decolorizing the printed portion, printing can be repeatedly carried out on the decolorized portion.

Accordingly, the decolorizable toner of the present invention can be preferably used for printing on a support such as copying paper or a passenger ticket, which can be repeatedly used by printing at the time of taking a train and erasing at the time of getting off, a coupon ticket and various tickets for admission.

The present invention is more specifically described and explained by means of the following Examples wherein all parts are by weight unless otherwise noted. It is to be understood that the present invention is not limited to the Examples, and various changes and modifications may be made in the invention without departing from the spirit and scope thereof.

Raw materials used in the following Examples, Reference Example and Preparation Examples are shown in Tables 1 to 6.

TABLE I

| Raw material | Name | Contents |
|---|---|---|
| Resin binder | RE-1 | Styrene-n-butyl acrylate-n-butyl methacrylate copolymer (TB ALMATEX CPR-200 commercially available from MITSUI TOATSU CHEMICALS INC) |
| | RE-2 | Styrene-butyl acrylate copolymer (TB ALMATEX CPR-100 commercially available from MITSUI TOATSU CHEMICALS INC.) |
| | RE-3 | Styrene-2-ethylhexyl acrylate copolymer (NIKALITE NC-6100 commercially available from Nippon Carbide Industries Co., Inc.) |
| | RE-4 | Polyester resin (resin having light yellow) (ER-101 commercially available from MITSUBISHI Rayon Co., Ltd.) |
| | RE-5 | Styrene-n-butyl acrylate-2-ethylhexyl acrylate copolymer (TB-1800 commercially available from SANYO CHEMICAL INDUSTRIES, LTD.) |
| | RE-6 | Styrene-acrylonitrile copolymer (AS-FD commercially available from SHOWA DENKO FCFC) |
| | RE-7 | Polyester resin (NE-382 commercially available from Kao Corporation) |
| | RE-8 | Polymethyl methacrylate resin (SUMIPEX B LG-6 commercially available from Sumitomo Chemical Company, Limited) |
| | RE-9 | Styrene-n-butyl methacrylate-n-butyl acrylate copolymer (melt viscosity: $6 \times 10^5$ poise (110° C.), $3 \times 10^4$ poise (140° C.)) |
| | RE-10 | Polyester (melt viscosity: $9 \times 10^4$ poise (110° C. ), $8 \times 10^3$ poise (140° C.)) |
| | RE-11 | Styrene-ethyl acrylate copolymer (melt viscosity: $9.5 \times 10^6$ poise (110° C.), $3 \times 10^5$ poise (140° C.)) |
| | RE-12 | Styrene-n-butyl acrylate copolymer (melt viscosity: $4 \times 10^4$ poise (110° C.), $2 \times 10^3$ poise (140° C.)) |
| | RE-13 | Styrene-methyl acrylate copolymer (melt viscosity: $5 \times 10^7$ poise (110° C.), $3 \times 10^6$ poise (140° C.)) |
| | RE-14 | Styrene-n-butyl acrylate copolymer (melt viscosity: $7 \times 10^3$ poise (110° C.), $4 \times 10^2$ poise (140° C.)) |
| | RE-15 | Styrene-n-butyl acrylate copolymer (light transmittance: 91%) |
| | RE-16 | Styrene-n-butyl methacrylate copolymer (light transmittance: 83%) |
| | RE-17 | Polyester (light transmittance: 65%) |
| | RE-18 | Styrene-methyl methacrylate-n-butyl acrylate terpolymer (light transmittance: 91%) |
| | RE-19 | Styrene-2-ethylhexyl acrylate-n-butyl acrylate terpolymer (light transmittance: 83%) |
| | RE-20 | Epoxy resin (light transmittance: 68%) |
| | RE-21 | Polyester (light transmittance: 80%) |
| | RE-22 | Polyester (light transmittance: 60%) |
| | RE-23 | Epoxy resin (light transmittance: 50%) |
| | RE-24 | Styrene-n-butyl acrylate copolymer (content in weight ratio: 94:6, softening point: 100° C.) |
| | RE-25 | Styrene-2-ethylhexyl acrylate copolymer (content in weight ratio: 92:8, softening point: 105° C.) |
| | RE-26 | Low molecular weight polyethylene (SANWAX 161-P commercially available from SANYO CHEMICAL INDUSTRIES, LTD.) |
| | Resin binder A | |
| | REA-1 | Styrene-n-butyl acrylate-n-butyl methacrylate copolymer (softening point: 100° C., glass transition temperature: 57° C.) |
| | REA-2 | Styrene-n-butyl acrylate-methyl methacrylate copolymer (softening point: 68° C., glass transition temperature: 59° C.) |
| | REA-3 | Styrene-n-butyl acrylate copolymer (softening point: 93° C., glass transition temperature: 60° C.) |
| | Resin binder B | |
| | REB-1 | Styrene-n-butyl acrylate copolymer (softening point: 128° C., glass transition temperature: 65° C.) |
| | REB-2 | Styrene-2-ethylhexyl acrylate copolymer (softening point: 112° C., glass transition temperature: 60° C.) |
| | REB-3 | Styrene-methyl methacrylate copolymer (softening point: 125° C., glass transition temperature: 65° C.) |

TABLE 3
| Raw material | Name | Contents |
|---|---|---|
| Near infrared ray-absorbing dye | DY-1 | 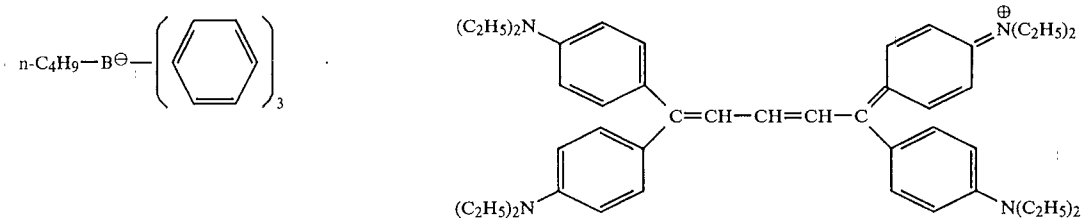 |
| | DY-2 | 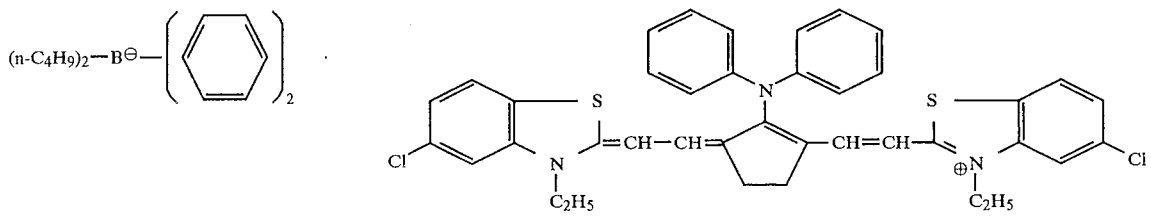 |
| | DY-3 | 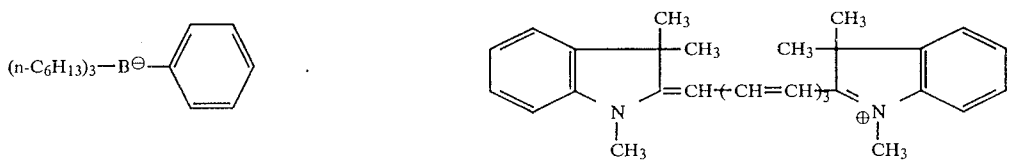 |
| | DY-4 | 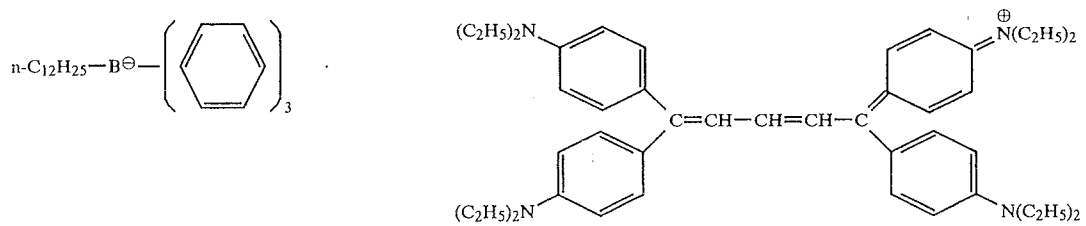 |
| Near infrared ray-absorbing dye | DY-5 | 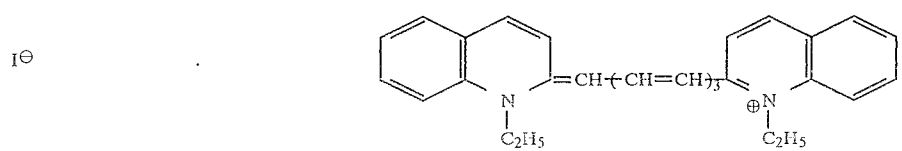 |

TABLE 3-continued
| Raw material | Name | Contents |
|---|---|---|
| | DY-6 | 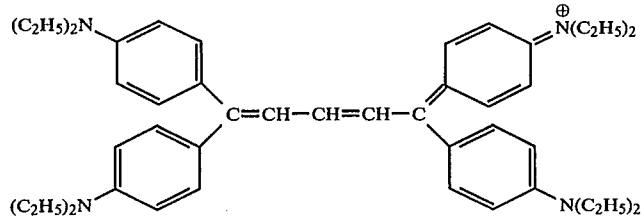 $CH_3C_6H_4SO_3^{\ominus}$ |
| | DY-7 | 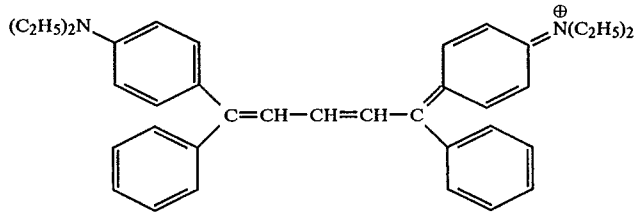 $BF_4^{\ominus}$ |
| Near infrared ray-absorbing dye | DY-8 | 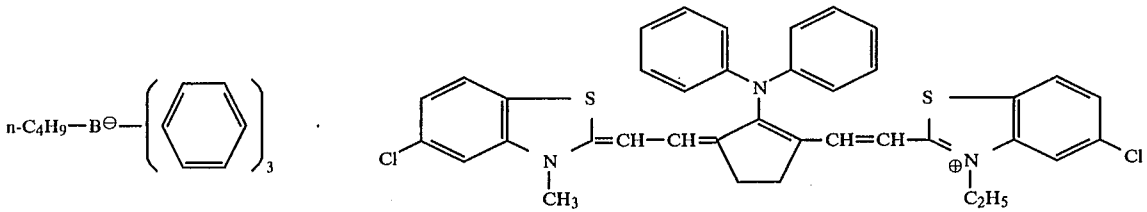 $n\text{-}C_4H_9-B^{\ominus}-\left(\bigcirc\right)_3$ |
| | DY-9 | 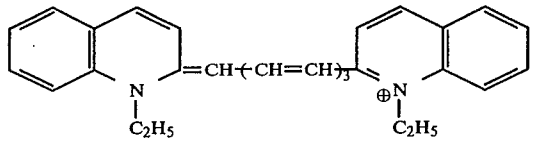 $n\text{-}C_4H_9-B^{\ominus}-\left(\bigcirc\right)_3$ |
| | DY-10 | 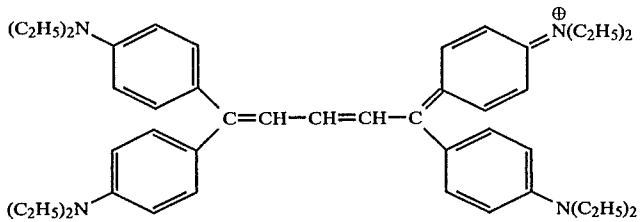 $CH_3C_2H_4SO_3^{\ominus}$ |

TABLE 3

| Raw material | Name | Contents |
|---|---|---|
| Decolorizing agent | SE-1 | Tetrabutylammonium n-butyltriphenyl borate |
| | SE-2 | Tetrabutylammonium dimethyldiphenyl borate |
| | SE-3 | Tetrabutylammonium dibutyldiphenyl borate |
| | SE-4 | Tetrametylammonium n-butyltriphenyl borate |
| | SE-5 | Tetrabutylammonium tetra-n-butyl borate |
| | SE-6 | Triethylhydrogenammonium n-butyltriphenyl borate |
| Wax (Polyolefin wax) | WA-1 | Polypropylene wax (VISCOL 550P commercially available from SANYO CHEMICAL INDUSTRIES, LTD.) |
| | WA-2 | Polypropylene wax (VISCOL 330P commercially available from SANYO CHEMICAL INDUSTRIES, LTD., softening point: 152° C., melt viscosity: 4000 centipoise (160° C.)) |
| | WA-3 | Polyethylene wax (HI-WAX 720P commercially available from MITSUI PETROCHEMICAL INDUSTRIES, LTD. softening point: 118° C., melt viscosity: 3800 centipoise (160° C.)) |
| | WA-4 | Polyethylene wax (HI-WAX 110P commercially available from MITSUI PETROCHEMICAL INDUSTRIES, LTD., softening point: 113° C., melt viscosity: about 12 centipoise (160° C.)) |

TABLE 4

| Raw material | Name | Contents |
|---|---|---|
| Near infrared ray-reflecting or -absorbing material | AD-1 | Heavy calcium carbonate (LIGHTON A commercially available from SHIRAISHI CALCIUM KAISYA. LTD.) |
| | AD-2 | Silica (SS-33S commercially available from Tokuyama Soda Co., Ltd.) |
| | AD-3 | Titanium oxide (ECT-52 commercially available from TITAN KOGYO KABUSHIKI KAISYA) |
| | AD-4 | Cerium oxide (MIREK commercially available from MITSUI MINING & SMELTING CO., LTD.) |
| | AD-5 | Titanium oxide (CR-60 commercially available from ISHIHARA SANGYO KAISHA, LTD.) |
| Light fastness stabilizer | Metal oxide | |
| | OA-1 | MgO (purity: 98.4%, average particle diameter: 0.06 μm) |
| | OA-2 | $Al_2O_3$ (purity: 54.0%, average particle diameter: 0.5 μm) |
| | OA-3 | Mixture of MgO and $Al_2O_3$ (purity: 52.7%, $MgO/Al_2O_3$ (weight ratio: 1/1, average particle diameter: 0.3 μm) |
| | OA-4 | $Al_2O_3 \cdot Na_2O \cdot CO_2$ ($Al_2O_3$: 35% by weight, $Na_2O$: 17.7% by weight, $CO_2$: 24.4% by weight, others such as CaO: 22.9% by weight, average particle diameter: 0.5 μm) |
| | OA-5 | $MgO \cdot Al_2O_3 \cdot CO_2$(MgO: 38.2% by weight, $Al_2O_3$ : 16.1% by weight, $CO_2$: 7.6% by weight, others: 38.1% by weight, average particle diameter: 0.3 μm) |
| | OA-6 | $SiO_2 \cdot MgO$ ($SiO_2$: 64.9% by weight, MgO: 13.5% by weight, others: 21.6% by weight, average particle diameter: 0.05 μm) |
| | OA-7 | $SiO_2 \cdot Al_2O_3$ ($SiO_2$: 60.2% by weight, $Al_2O_3$: 10.5% by weight, others: 24.6% by weight, average particle diameter: 0.5 μm) |
| | Metal soap | |
| | MS-1 | Zinc stearate (SZ #2000 commercially available from Sakai Chemical Industry Co., Ltd.) |
| | MS-2 | Zinc laurate (Z-12 commercially available from Sakai Chemical Industry Co., Ltd.) |
| | MS-3 | Barium stearate (commercially available from WAKO JUNYAKU KOGYO KABUSHIKI KAISHA) |
| | MS-4 | Calcium stearate (commercially available from WAKO JUNYAKU KOGYO KABUSHIKI KAISHA) |
| | MS-5 | Lead 2-ethylhexylate (commercially available from WAKO JUNYAKU KOGYO KABUSHIKI KAISHA) |

TABLE 5

| Raw material | Name | Contents |
|---|---|---|
| Light fastness stabilizer | Heat-resistant age resistor | |
| | AO-1 | 1-oxy-3-methyl-4-isopropylbenzene |
| | AO-2 | 2,5-Dihydroquinone |
| | AO-3 | Alkylated phenol (Antioxidant NV3 commercially available from BASF AKITIENGESELLSCHAFT) |
| | AO-4 | Triphenyl phosphite |
| | AO-5 | p-Diphenylamine |
| | AO-6 | 2,2-Bis(4-hydroxyphenyl)propane |
| | AO-7 | Ethyl p-hydroxybenzoate (PEF-FP commercially available from UENO FINE CHEMCIALS INDUSTRY, LTD.) |
| | AO-8 | n-Propyl gallate |
| | AO-9 | Lauryl gallate |
| | AO-10 | Resorcinol |
| | AO-11 | 3,4-Dihydroxy-4-diphenylsulphone (CD-180 commercially available from SHOWA DENKO K.K.) |
| Electric charge regulator | CR-1 | Quaternary ammonium salt (BONTRON P-51 commercially available from ORIENT CHEMICAL INDUSTRIES, LTD.) |
| | CR-2 | KAYACHARGE N-1 commercially available from NIPPON KAYAKU CO., LTD. |
| | CR-3 | FCA-1001N commercially available from FUJIKURA KASEI CO., LTD. |
| | CR-4 | TP-415 commercially available from HODOGAYA CHEMICAL CO., LTD. |
| | CR-5 | FCA-201PB commercially available from FUJIKURA KASEI CO., LTD. |

TABLE 6

| Raw material | Name | Contents |
|---|---|---|
| Ultraviolet absorbing agent | UA-1 | Phenyl salicylate |
| | UA-2 | 2-Hydroxy-4-methoxybenzophenone |
| | UA-3 | 2-(2'-Hydroxy-5'-methylphenyl)benzotriazole |
| | UA-4 | Bis (2,2,6,6-tetramethyl-4-piperidyl)sebacate |

TABLE 6-continued

| Raw material | Name | Contents |
|---|---|---|
| Electrically chargeable fine particles | Organic fine particles | |
| | TE-1 | Polymethyl methacrylate (FINE POWDER MP1000 commercially available from SOKEN CHEMICAL & ENGINEERING CO., LTD., average particle diameter: 0.4 μm, negatively chargeable) |
| | TE-2 | Polymethylmethacrylate (FINE POWDER MP2701 commercially available from SOKEN CHEMICAL & ENGINEERING CO., LTD., average particle diameter: 0.4 μm, negatively chargeable) |
| | TE-3 | Polyvinyl idene fluoride (KYNAR 301F commercially available from MITSUBISHI PETROCHEMICAL COMPANY, LTD., average particle diameter: 0.3 μm, Inorganic fine particles negatively chargeable) |
| | TE-4 | Colloidal silica (AEROSIL R-972 commercially available from NIPPON AEROSIL CO., LTD., average particle diameter: 0.1 μm, negatively chargeable) |
| | TE-5 | Titanium dioxide (IDEMITSU TITANIA IT-OD commercially available from IDEMITSU KOSAN CO., LTD., average particle diameter: 0.2 μm, negatively chargeable) |
| | TE-6 | Titanium dioxide (commercially available from TITAN KOGYO KABUSIKI KAISHA, average particle diameter: 0.2 μm, negatively chargeable) |
| Organic solvent | SO-1 | Tetrahydrofuran |
| | SO-2 | Toluene |
| | SO-3 | Dichloromethane |
| | SO-4 | Ethyl acetate |
| | SO-5 | Methyl ethyl ketone |

EXAMPLE 1

[Experiments 1 to 10 and Comparative Experiments 1 to 4]

Raw materials shown in Tables 1 to 3 and 5 were blended in a blending ratio shown in Table 7 to give a uniformly blended mixture.

Then, 20 parts of the mixture and 80 parts of 1,1,2,2-tetrachloroethane were mixed together, and the mixture was sufficiently dissolved to or dispersed in the 1,1,2,2-tetrachloroethane to give a toner solution.

The toner solution was coated on a white copying paper with a brush so that a toner layer having a thickness of 20 to 30 μm in dry could be formed, and solvent was vaporized to remove from the toner layer to give a sample.

As a physical property of the sample, light resistance A was evaluated in accordance with the following method. The result is shown in Table 7.

(Light resistance A)

The sample was allowed to stand for 10 days at room temperature in the shade of a room which gets direct rays of the sun through a window glass during fine weather. The discoloration of the sample was examined by comparing the sample with a sample to which the natural light was not irradiated, and evaluated in accordance with the following criteria for evaluation.

[Criteria for evaluation]

A: No change of color is observed in the sample.

B: A slight change of color is observed in the sample.

C: A little change of color is observed in the sample.

D: Change of color is obviously observed.

When the decolorizing property of the decolorizable toners obtained in Experiments 1 to 10 of Example 1 was examined by irradiating near infrared rays to the decolorizable toners, it was observed that all of the decolorizable toners stood comparison with the toners not containing a heat-resistant age resistor and exhibited practically satisfactory decolorizing property.

TABLE 7

| Experiment No. | Components of decolorizable toner (parts) | | | | | Light resistance A of decolorizable toner |
|---|---|---|---|---|---|---|
| | Resin binder | Near infrared ray-absorbing dye | De-colorizing agent | Wax | Light fastness stabilizer (Heat-resistant age resistor) | |
| 1 | RE-1 (100) | DY-1 (2) | SE-1 (2.84) | WA-1 (5) | AO-2 (2) | A |
| 2 | RE-1 (100) | DY-1 (2) | SE-1 (2.84) | WA-1 (5) | AO-5 (20) | A |
| 3 | RE-1 (100) | DY-1 (2) | SE-1 (2.84) | WA-1 (5) | AO-3 (2) | A |
| 4 | RE-1 (100) | DY-2 (2) | SE-1 (2.84) | WA-1 (5) | AO-4 (5) | A |
| 5 | RE-2 (100) | DY-3 (20) | SE-2 (5) | WA-1 (1) | AO-1 (0.5) | A |
| 6 | RE-3 (100) | DY-4 (10) | SE-2 (10) | WA-1 (15) | AO-4 (15) | A |
| 7 | RE-4 (100) | DY-5 (15) | SE-3 (10) | WA-1 (10) | AO-4 (25) | A |
| 8 | RE-2 (100) | DY-6 (2) | SE-3 (10) | WA-1 (5) | AO-2 (10) | A |
| 9 | RE-1 (100) | DY-7 (10) | SE-2 (20) | — | AO-4 (5) | A |
| 10 | RE-2 (100) | DY-8 (2) | SE-4 (20) | WA-1 (5) | AO-5 (5) | A |
| Comparative Experiment | | | | | | |
| 1 | RE-1 (100) | DY-1 (2) | SE-1 (2.84) | WA-1 (5) | — | C |
| 2 | RE-2 (100) | DY-2 (2) | SE-2 (5) | WA-1 (5) | — | D |
| 3 | RE-3 (100) | DY-3 (2) | SE-3 (5) | WA-1 (5) | — | C |
| 4 | RE-1 (100) | DY-4 (10) | SE-2 (10) | WA-1 (0.05) | — | D |

From the results shown in Table 7, it can be understood that all of the decolorizable toners containing a heat-resistant age resistor obtained in Experiments 1 to 10 have excellent light resistance.

[Experiments 11 to 19 and Comparative Experiments 5 to 7]

The procedure of Experiments 1 to 10 and Comparative Experiments 1 to 4 of Example 1 was repeated to give a toner solution except that raw materials shown in Tables 1 to 3 and 5 were blended in a blending ratio shown in Table 8.

Then, the procedure of Experiments 1 to 10 and Comparative Experiments 1 to 4 of Example 1 was repeated to give a sample.

As physical properties of the sample, light resistance B and decolorizing property were evaluated in accordance with the following methods. The results are shown in Table 8.

(Light resistance B)

The sample was allowed to stand for one week under a fluoroescent lamp (illumination intensity: 1500 lux). A reflection density of the sample after allowing to stand and the reflection density of the sample before allowing to stand were measured by using a Macbeth densitometer, and the rate of change of reflection density was calculated by the following equation.

[Rate of change of reflection density (%)]=[(Reflection density of the sample after allowing to stand)/(Reflection density of the sample before allowing to stand)×100]

Then, the light resistance B was evaluated in accordance with the following criteria for evaluation.

[Criteria for evaluation]

A: Rate of change of reflection density is not less than 80% (Light resistance is very excellent).

B: Rate of change of reflection density is not less than 60% and less than 80% (Light resistance is excellent).

C: Rate of change of reflection density is not less than 40% and less than 60% (Light resistance is good).

D: Rate of change of reflection density is less than 40% (Light resistance is bad).

When the decolorizing property of the decolorizable toners obtained in Experiments 11 to 19 of Example 1 was examined by irradiating near infrared rays to the decolorizable toners, it was observed that all of the decolorizable toners stood comparison with the toners not containing a heat-resistant age resistor of Comparative Experiments 5 to 7 and exhibited practically satisfactory decolorizing property.

TABLE 8

| Experiment No. | Components of decolorizable toner (parts) | | | | | Light resistance B of decolorizable toner |
|---|---|---|---|---|---|---|
| | Resin binder | Near infrared ray-absorbing dye | De-colorizing agent | Wax | Light fastness stabilizer (Heat-resistance age resistor) | |
| 11 | RE-1 (100) | DY-1 (2) | SE-1 (3) | WA-1 (3) | AO-6 (1) | B |
| 12 | RE-1 (100) | DY-2 (2) | SE-1 (4) | WA-1 (3) | AO-6 (5) | B |
| 13 | RE-3 (100) | DY-3 (2) | SE-2 (5) | WA-1 (3) | AO-7 (2) | B |
| 14 | RE-3 (100) | DY-4 (2) | SE-2 (3) | WA-1 (3) | AO-7 (5) | A |
| 15 | RE-2 (100) | DY-5 (2) | SE-3 (4) | WA-1 (3) | AO-8 (0.5) | B |
| 16 | RE-2 (100) | DY-6 (2) | SE-3 (4) | WA-1 (3) | AO-8 (2) | A |
| 17 | RE-2 (100) | DY-1 (2) | SE-3 (4) | WA-1 (3) | AO-9 (1) | B |
| 18 | RE-1 (100) | DY-1 (2) | SE-4 (3) | WA-1 (3) | AO-9 (5) | A |
| 19 | RE-3 (100) | DY-1 (2) | SE-4 (3) | WA-1 (3) | AO-10 (2) | A |
| Comparative Experiment | | | | | | |
| 5 | RE-1 (100) | DY-1 (2) | SE-1 (3) | WA-1 (3) | — | D |
| 6 | RE-2 (100) | DY-2 (2) | SE-1 (4) | WA-1 (3) | — | D |
| 7 | RE-3 (100) | DY-3 (2) | SE-2 (5) | WA-1 (3) | — | D |

From the results shown in Table 8, it can be understood that all of the decolorizable toners containing a heat-resistant age resistor obtained in Experiments 11 to 19 have excellent light resistance.

EXAMPLE 2

[Experiments 1 to 11 and Comparative Experiments 1 to 2]

Raw materials shown in Tables 1 to 3 and 5 were blended in a blending ratio shown in Table 9 and weighed so that the total amount could be 800 g, and all of the raw materials were thrown into a pressure kneader having an effective volume of 2 g. Then, the kneader was heated, and the kneading temperature of the raw materials was adjusted to 130° C. After the raw materials were kneaded for 15 minutes, the obtained kneaded material was taken out from the kneader and cooled to give a solidified product.

Then, the obtained solidified product was ground with a jet mill and classified by using an air classifier to give toner particles having an average particle diameter of about 12 μm. To the toner particles was added 0.3% by weight of silica commercially available from NIPPON AEROSIL CO., LTD. under the trade name of R-972, and they were mixed by using a Henschel mixer to give a toner.

As physical properties of the toner, decolorizing property and visible light resistance were evaluated in accordance with the following methods. The results are shown in Table 9.

(Decolorizing property)

Four parts of the toner and 100 parts of a silicone resin-coated carrier commercially available from POWDERTECH CO., LTD. under the trade name of F97-2535 were mixed to give a uniformly mixed developer.

A copying machine commercially available from SANYO ELECTRIC CO., LTD. under the trade name of SFT-Z70 was charged with the obtained developer, and an image was duplicated on a paper for plain paper copy using a test chart No. 1-R1975 prescribed by THE SOCIETY OF ELECTROGRAPHY OF JAPAN.

Near infrared rays were irradiated to the image-duplicated paper from an aluminum-coated halogen lamp (2 W/cm$^2$) which was placed at a distance of 30 cm from the paper for 3 seconds. Five sheets of the paper and five sheets of non-duplicated paper were put on a perpendicular wall at random, and they were observed with naked eyes whether they were duplicated or not at a distance of 5 m from the wall. The distinction was carried out by five men and five women, and when the duplicated paper-was recognized as a non-duplicated paper, one point was given. Then, total point of ten persons was counted, and decolorizing property was evaluated in accordance with the following criteria for evaluation.

[Criteria for evaluation]

A: 40 to 50 points
B: 30 to 39 points
C: 20 to 29 points
D: 0 to 19 points (Visible light resistance)

After a transparent glass vessel was charged with the obtained toner and the toner was preserved for 10 days at room temperature in an experimental room which could get natural light, the color of the toner was compared with the color of a toner which was preserved for 10 days at room temperature in a dark room with naked eyes, and visible light resistance was evaluated in accordance with the following criteria for evaluation.

A: No change of color is observed in the toner.
B: A slight change of color is observed in the toner, but there is practically no problem in the toner.
C: A little change of color is observed in the toner, but there is practically no problem in the toner.
D: Change of color is obviously observed in the toner, and the toner is not suited for practical uses.

obtained kneaded material was taken out from the kneeder and cooled to give a solidified product.

Then, the obtained solidified product was ground with a jet mill and classified by using an air classifier to give toner particles having an average particle diameter of about 11 μm. To the toner particles was added 0.2% by weight of hydrophobic silica commercially available from NIPPON AEROSIL CO., LTD. under the trade name of R-972, and they were mixed by using a Henschel mixer to give a toner.

As a physical property of the toner, printed trace after decolorizing was evaluated in accordance with the following method. The results are shown in Table 10.

(Printed trace after decolorizing)

Four parts of the toner and 100 parts of a silicone resin-coated carrier commercially available from POWDERTECH CO., LTD. under the trade name of F97-2535 were mixed together to give a uniformly mixed developer.

A copying machine commercially available from SANYO ELECTRIC CO., LTD. under the trade name of SFT-Z70 was charged with the obtained developer, and an image was duplicated on a paper for plain paper copy using a test chart No. 1-R1975 prescribed by THE SOCIETY OF ELECTROGRAPHY OF JAPAN.

TABLE 9

| | Components of decolorizable toner (parts) | | | | | Physical properties of decolorizable toner | |
|---|---|---|---|---|---|---|---|
| Experiment No. | Resin binder | Near infrared ray-absorbing dye | De-colorizing agent | Wax | Electric charge regulator | Decolorizing property | Visible light resistance |
| 1 | RE-9 (100) | DY-1 (5) | SE-1 (3) | WA-1 (3) | CR-1 (3) | A | A |
| 2 | RE-10 (100) | DY-1 (2) | SE-1 (1) | WA-1 (3) | CR-1 (3) | A | A |
| 3 | RE-11 (100) | DY-1 (3) | SE-1 (2) | WA-1 (3) | CR-1 (3) | B | A |
| 4 | RE-12 (100) | DY-1 (6) | SE-1 (4) | WA-1 (3) | CR-1 (3) | A | B |
| 5 | RE-9 (100) | DY-2 (4) | SE-1 (3) | WA-1 (3) | CR-1 (3) | A | A |
| 6 | RE-9 (100) | DY-3 (5) | SE-5 (3) | WA-1 (3) | CR-1 (3) | A | A |
| 7 | RE-9 (100) | DY-4 (3) | SE-3 (2) | WA-1 (3) | CR-1 (3) | A | A |
| 8 | RE-9 (100) | DY-5 (5) | SE-6 (10) | WA-1 (3) | CR-1 (3) | A | A |
| 9 | RE-9 (100) | DY-6 (2) | SE-1 (4) | WA-1 (3) | CR-1 (3) | A | A |
| 10 | RE-9 (100) | DY-7 (4) | SE-5 (8) | WA-1 (3) | CR-1 (3) | A | A |
| 11 | RE-9 (100) | DY-8 (5) | SE-3 (3) | WA-1 (3) | CR-1 (3) | A | A |
| Comparative Experiment | | | | | | | |
| 1 | RE-13 (100) | DY-1 (5) | SE-1 (3) | WA-1 (3) | CR-1 (3) | C | A |
| 2 | RE-14 (100) | DY-1 (5) | SE-1 (3) | WA-1 (3) | CR-1 (3) | A | C |

From the results shown in Table 9, it can be understood that all of the decolorizable toners containing a resin binder having a melt viscosity of not more than $10^7$ poise at 110° C. and a melt viscosity of not less than $10^3$ poise at 140° C. obtained in Experiments 1 to 11 have excellent decolorizing property and excellent visible light resistance.

EXAMPLE 3

[Experiments 1 to 10 and Comparative Experiments 1 to 5]

Raw materials shown in Tables 1 to 3 were weighed in a ratio shown in Table 10 so that the total amount could be 800 g, and all of the raw materials were thrown into a pressure kneeder having an effective volume of 2 l. Then, the kneeder was heated, and the kneading temperature of the raw materials was adjusted to 120° C. After the raw materials were kneaded for 5 minutes, the Near infrared rays were irradiated to the image-duplicated paper from a dichroic coat type halogen lamp (2 W/cm$^2$) for 2 seconds. Five sheets of the paper and five sheets of non-duplicated paper were put on a perpendicular wall at random, and they were observed with naked eyes whether they were duplicated or not at a distance of 5 m from the wall. The distinction was carried out by five men and five women, and when the duplicated paper was recognized as a non-duplicated paper, one point was given. Then, total point of ten persons was counted, and decolorizing property was evaluated in accordance with the following criteria for evaluation.

[Criteria for evaluation]

A: 40 to 50 points
B: 30 to 39 points
C: 20 to 29 points
D: 0 to 19 points

TABLE 10

| Experiment No. | Components of decolorizable toner (parts) Resin binder | Near infrared ray-absorbing dye | Decolorizing agent | Wax | Physical property of decolorizable toner Printed trace after decolorizing |
|---|---|---|---|---|---|
| 1 | RE-15 (100) | DY-1 (20) | SE-1 (5) | WA-2 (1) | A |
| 2 | RE-15 (100) | DY-1 (20) | SE-1 (5) | WA-2 (1) | A |
| 3 | RE-16 (100) | DY-2 (2) | SE-2 (5) | — | A |
| 4 | RE-16 (100) | DY-3 (2) | SE-3 (5) | — | A |
| 5 | RE-18 (100) | DY-4 (10) | SE-2 (10) | WA-2 (1) | A |
| 6 | RE-18 (100) | DY-5 (5) | SE-1 (10) | WA-2 (1) | A |
| 7 | RE-19 (100) | DY-6 (2) | SE-2 (10) | — | A |
| 8 | RE-19 (100) | DY-7 (2) | SE-3 (10) | — | A |
| 9 | RE-21 (100) | DY-8 (5) | SE-2 (20) | WA-2 (1) | A |
| 10 | RE-21 (100) | DY-1 (1) | SE-4 (20) | WA-2 (5) | A |
| Comparative Experiment | | | | | |
| 1 | RE-17 (100) | DY-1 (20) | SE-1 (5) | WA-2 (1) | D |
| 2 | RE-20 (100) | DY-1 (20) | SE-1 (5) | WA-2 (1) | C |
| 3 | RE-22 (100) | DY-2 (2) | SE-2 (5) | — | D |
| 4 | RE-23 (100) | DY-3 (2) | SE-3 (5) | — | D |
| 5 | RE-17 (100) | DY-4 (10) | SE-2 (10) | WA-2 (1) | C |

From the results shown in Table 10, it can be understood that all of the decolorizable toners containing a thermoplastic resin having a light transmittance of not less than 80% as a resin binder, which were obtained in Experiments 1 to 10, produce little afterimage after decolorizing even though decolorizing time is short.

EXAMPLE 4

[Experiments 1 to 10 and Comparative Experiments 1 to 5]

Raw materials shown in Tables 1 to 4 were weighed in a ratio shown in Table 11 so that the total amount could be 800 g. Then, all of the raw materials were thrown into a pressure kneader having an effective volume of 2 l. The kneader was heated, and the kneading temperature of the raw materials was adjusted to 130° C. After the raw materials were kneaded for 15 minutes, the obtained kneaded material was taken out from the kneader and cooled to give a solidified product.

Then, the obtained solidified product was ground with a jet mill and classified by using an air classifier to give toner particles having an average particle diameter of about 12 μm. To the toner particles was added 0.3% by weight of silica commercially available from NIPPON AEROSIL CO., LTD. under the trade name of R-972 to give a toner.

As a physical property of the toner, decolorizing property was evaluated in the same manner as in Example 2. The results are shown in Table 11.

TABLE 11

| Experiment No. | Components of decolorizable toner (parts) Resin binder | Near infrared ray-absorbing dye | Decolorizing agent | Wax (polyolefin wax) | Near infrared ray-reflecting or -absorbing material | Decolorizing property |
|---|---|---|---|---|---|---|
| 1 | RE-24 (100) | DY-1 (20) | SE-1 (5) | WA-2 (1) | — | A |
| 2 | RE-24 (100) | DY-1 (20) | SE-1 (5) | WA-2 (1) | AD-1 (5) | A |
| 3 | RE-25 (100) | DY-2 (2) | SE-2 (5) | WA-3 (15) | AD-3 (5) | A |
| 4 | RE-25 (100) | DY-3 (2) | SE-3 (5) | WA-3 (5) | AD-2 (10) | A |
| 5 | RE-24 (100) | DY-4 (10) | SE-2 (10) | WA-2 (1) | AD-4 (5) | A |
| 6 | RE-24 (100) | DY-5 (20) | SE-1 (10) | WA-2 (1) | AD-1 (5) | A |
| 7 | RE-25 (100) | DY-6 (2) | SE-2 (10) | WA-3 (15) | AD-3 (7) | A |
| 8 | RE-25 (100) | DY-7 (2) | SE-3 (10) | WA-3 (5) | AD-2 (10) | A |
| 9 | RE-24 (100) | DY-8 (10) | SE-2 (20) | WA-2 (1) | AD-4 (5) | A |
| 10 | RE-25 (100) | DY-1 (1) | SE-4 (20) | WA-2 (5) | — | A |
| Comparative Experiment | | | | | | |
| 1 | RE-24 (100) | DY-1 (20) | SE-1 (5) | — | AD-1 (5) | D |
| 2 | RE-24 (100) | DY-1 (20) | SE-1 (5) | — | — | C |
| 3 | RE-25 (100) | DY-2 (2) | SE-2 (5) | WA-4 (5) | AD-3 (10) | D |
| 4 | RE-26 (100) | DY-3 (2) | SE-3 (5) | WA-3 (5) | AD-2 (10) | D |
| 5 | RE-24 (100) | DY-4 (10) | SE-2 (10) | WA-2 (0.05) | AD-4 (5) | C |

From the results shown in Table 11, it can be understood that all of the decolorizable toners containing a specific polyolefin wax, which were obtained in Experiments 1 to 10 have excellent decolorizing property nevertheless a near infrared ray-reflecting or -absorbing material is contained in the decolorizable toners. Moreover, it can be recognized that the toners obtained in Comparative Experiments 1 to 2 have bad decolorizing property because a polyolefin wax is not contained in the toners, and the toner obtained in Comparative Experiment 5 has bad decolorizing property because only a little amount of polyolefin wax is contained in the toner. Furthermore, it can be recognized that when a resin having a compatibility with a polyolefin wax is used as a resin binder, as is clear from the result of Comparative Experiment 4, decolorizing property of the toner is lowered because a lens effect is not imparted to the toner by the polyolefin wax.

Reference Example 1

Raw materials shown in Tables 1 to 4 were blended in a blending ratio shown in Experiments 1 to 23 or Comparative Experiment 1 of Table 12 to give a mixture. Then, 20 parts of the mixture and 80 parts of 1,1',2,2'-tetrachloroethylene (hereinafter referred to as "TCE") were blended with stirring to give a uniform solution.

The solution was used as a blank sample in measuring the absorbance of a solution. Components of a blank sample used in each of Experiments 1 to 23 and Comparative Experiment 1 were prepared so as to correspond to the components used in each of Experiments 1 to 23 and Comparative Experiment 1 as shown in Table 12.

EXAMPLE 5

[Experiments 1 to 23 and Comparative Experiment 1]

Raw materials shown in Tables 1 to 4 were blended in a blending ratio shown in Table 12 to give a mixture. The mixture was kneaded by using a LABO PLAST MILL/model: 20C200, chamber volume: 60 ml) commercially available from TOYO SEIKI SEISAKU-SYO., LTD. under the condition that the mixing chamber temperature is 120° C., the filled content in the mixing chamber is 70% and heading time is minutes, so that shearing stress was added to the resin binder.

Then, 20 parts of the kneaded material and 80 parts of TCE were mixed together with stirring to give a uniform toner solution.

Absorbance of the toner solution was measured at a wavelength of 640 nm by using a spectrophotometer UV/VIS-660 commercially available from JASCO CORPORATION. Then, the ratio of absorbance of the toner solution was measured based upon the absorbance of the blank sample obtained in Reference Example 1 of 100. The results are shown in Table 12.

Moreover, discoloration and storage stability of the obtained kneaded material were evaluated in accordance with the following methods. The results are shown in Table 12.

(Discoloration)

The color of the kneaded material was compared with the color of the blank sample with naked eyes, and discoloration was evaluated in accordance with the following criteria for evaluation.

[Criteria for evaluation]

A: No change of color is observed in the kneaded material.

B: A slight change of color is observed in the kneaded material, but there is practically no problem.

A little change of color observed in the kneaded material, but there is practically no problem.

D: Discolor is obviously observed in the kneaded material, and the kneaded material is not suited for practical uses.

(Storage stability)

After a transparent glass vessel was charged with the kneaded material and preserved for 10 days at room temperature in an experimental room which could get natural light, the color of the kneaded material was compared with the color of the blank sample with naked eyes, and storage stability was evaluated in accordance with the above-mentioned criteria for evaluation of discoloration.

TABLE 12

| | Components of decolorizable toner (parts) | | | | | Physical properties of decolorizable toner | | |
|---|---|---|---|---|---|---|---|---|
| Experiment No. | Resin binder | Near infrared ray-absorbing dye | Decolorizing agent | Wax | Light fastness stabilizer (Metal oxide) | Ratio of absorbance (%) | Discoloration | Storage stability |
| 1 | RE-1 (100) | DY-9 (2) | SE-1 (2.84) | WA-1 (5) | OA-1 (10) | 82 | A | A |
| 2 | RE-1 (100) | DY-1 (2) | SE-1 (2.84) | WA-1 (5) | OA-2 (10) | 68 | B | B |
| 3 | RE-1 (100) | DY-6 (2) | SE-1 (2.84) | WA-1 (5) | OA-3 (10) | 84 | A | A |
| 4 | RE-1 (100) | DY-4 (2) | SE-1 (2.84) | WA-1 (5) | OA-4 (10) | 75 | A | A |
| 5 | RE-1 (100) | DY-5 (2) | SE-1 (2.84) | WA-1 (5) | OA-5 (10) | 80 | A | A |
| 6 | RE-1 (100) | DY-10 (2) | SE-1 (2.84) | WA-1 (5) | OA-6 (10) | 80 | A | A |
| 7 | RE-1 (100) | DY-7 (2) | SE-1 (2.84) | WA-1 (5) | OA-7 (10) | 71 | B | B |
| 8 | RE-1 (100) | DY-8 (2) | SE-1 (2.84) | WA-1 (5) | OA-1 (2) | 75 | A | B |
| 9 | RE-1 (100) | DY-9 (2) | SE-1 (2.84) | WA-1 (5) | OA-1 (5) | 82 | A | A |
| 10 | RE-1 (100) | DY-1 (2) | SE-1 (2.84) | WA-1 (5) | OA-1 (50) | 80 | A | A |
| 11 | RE-1 (100) | DY-6 (2) | SE-1 (2.84) | WA-1 (5) | OA-6 (50) | 80 | A | A |
| 12 | RE-2 (100) | DY-4 (2) | SE-2 (3.85) | WA-1 (5) | OA-1 (10) | 84 | A | A |
| 13 | RE-3 (100) | DY-5 (2) | SE-3 (3.5) | WA-1 (5) | OA-3 (2) | 78 | A | B |
| 14 | RE-4 (100) | DY-10 (2) | SE-1 (2.84) | WA-1 (5) | OA-4 (2) | 72 | B | B |
| 15 | RE-1 (100) | DY-7 (2) | SE-2 (3.5) | WA-1 (5) | OA-5 (5) | 75 | A | B |
| 16 | RE-1 (100) | DY-8 (2) | SE-3 (3.5) | WA-1 (5) | OA-6 (5) | 80 | A | A |
| 17 | RE-1 (100) | DY-9 (20) | SE-1 (10) | WA-1 (5) | OA-1 (10) | 85 | A | A |
| 18 | RE-1 (100) | DY-1 (0.2) | SE-1 (20) | WA-1 (5) | OA-1 (10) | 72 | B | B |
| 19 | RE-1 (100) | DY-6 (5) | SE-2 (5) | WA-1 (5) | OA-3 (5) | 80 | A | A |
| 20 | RE-1 (100) | DY-4 (10) | SE-3 (20) | WA-1 (5) | OA-3 (5) | 80 | A | B |
| 21 | RE-1 (100) | DY-5 (0.2) | SE-1 (40) | WA-1 (5) | OA-4 (10) | 72 | B | C |
| 22 | RE-1 (100) | DY-10 (0.2) | SE-2 (0.2) | WA-1 (5) | OA-4 (10) | 72 | B | B |
| 23 | RE-3 (100) | DY-7 (20) | SE-1 (0.2) | WA-1 (5) | OA-4 (10) | 85 | A | A |
| Comparative Experiment | | | | | | | | |
| 1 | RE-1 (100) | DY-9 (2) | SE-1 (2.84) | WA-1 (5) | — | 54 | D | D |

From the results shown in Table 12, it can be understood that all of the decolorizable toners containing a metal oxide as a light fastness stabilizer obtained in Experiments 1 to 23 do not discolor although the toner obtained in Comparative Experiment 1 shows change of color, and these decolorizable toners have excellent strage stability.

Then, the kneaded materials obtained in Experiments 1 to 23 of Example 5, from which a solvent was removed, were ground by using a jet mill and classified by using an air classifier to give toner particles having an average particle diameter of about 12 μm. To the toner particles was added 0.3% by weight of silica commercially available from NIPPON AEROSIL CO., LTD. under the trade name of R-972, and they were mixed by using a Henschel mixer to give a toner.

When decolorizing property of the obtained toners was examined by irradiating near infrared rays to the developed image formed from the toners on a copying paper using an aluminum-coated halogen lamp (2 W/cm$^2$), which was placed at a distance of 30 cm from the developed image for one hour, it was observed that all of the toners obtained in each of Experiments had excellent decolorizing property and were suited for practical uses.

[Experiments 24 to 28 and Comparative Experiment 2]

The procedure of Experiment 1 of Example 5 was repeated to give a toner solution except that raw materials shown in Tables 1 to 4 were blended in a ratio shown in Table 13.

The toner solution was coated on a white copying paper with a brush so that a toner layer having a thickness of about 20 to 25 μm in dry could be formed. After the toner layer was dried, near infrared rays were irradiated to the toner layer using a dichroic coat type halogen lamp (2 W/cm$^2$) which was placed at a distance of 30 cm from the paper for 1 hour to decolorize the toner.

Then, the transparency and glossiness of the afterimage of the toner on the paper were evaluated with naked eyes. The results are shown in Table 13.

TABLE 13

| Experiment No. | Components of decolorizable toner (parts) Resin binder | Near infrared ray-absorbing dye | Decolorizing agent | Wax | Light fastness stabilizer (Metal oxide) | Physical properties of decolorizable toner Transparency | Glossiness |
|---|---|---|---|---|---|---|---|
| 24 | RE-1 (100) | DY-9 (2) | SE-1 (2.84) | WA-1 (5) | OA-1 (2) | Translucent (White) | Slightly glossy |
| 25 | RE-1 (100) | DY-9 (2) | SE-1 (2.84) | WA-1 (5) | OA-1 (5) | Translucent (White) | Flat |
| 26 | RE-1 (100) | DY-9 (2) | SE-1 (2.84) | WA-1 (5) | OA-1 (10) | Translucent (White) | Flat |
| 27 | RE-1 (100) | DY-9 (2) | SE-1 (2.84) | WA-1 (5) | OA-1 (50) | Opaque (White) | Flat |
| 28 | RE-2 (100) | DY-9 (2) | SE-1 (2.84) | WA-1 (5) | OA-6 (50) | Opaque (White) | Flat |
| Comparative Experiment 2 | RE-1 (100) | DY-9 (2) | SE-1 (2.84) | WA-1 (5) | — | Translucent (Light yellow) | Glossy |

From the results shown in Table 13, it can be understood that when a metal oxide is contained in the toner as a light fastness stabilizer as shown in Experiments 24 to 28, the gloss of the copying paper becomes nearly equal to the gloss of an original copying paper in comparison with the toner not containing a metal oxide as shown in Comparative Experiment 2. Moreover, it can be understood that when the amount of the metal oxide is increased in the toner, the trace of the toner after decolorizing becomes from translucent to opaque, and the color of the trace becomes close to the color of the copying paper.

[Experiments 29 to 39 and Comparative Experiments 3 to 4]

Raw materials shown in Tables 1 to 4 were weighed in a ratio shown in Table 14 so that the total amount could be 800 g, and all of the raw materials were thrown into a pressure kneader having an effective volume of 2 l. Then, the kneader was heated, and kneading temperature of the raw materials was adjusted to 130° C. After the raw materials were kneaded for 15 minutes, an obtained kneaded material was taken out from the kneader and cooled to give a solidified product.

The obtained solidified product was pulverized by using a cutter mill to give a toner having a particle diameter of about 1 min.

As physical properties of the toner, thermal discoloration and light stability were evaluated in accordance with the following methods. The results are shown in Table 14.

(Thermal discoloration)

Since evaluating the thermal discoloration of the pulverized toner was impossible as if was, the toner was formed into a pellet having a thickness of 2 mm by pressing the toner with a hydraulic press under a pressure of 700 kg.f/cm$^2$. As thermal discoloration, a reflection density of the pellet was measured by using a Macbeth densitomer. The higher the value of the reflection density is, the smaller the thermal discoloration is.

(Light stability)

After the pellet was allowed to stand for 48 hours under a fluorescent lamp (illumination intensity: 1500 lux), the reflection density was measured in the same manner as in evaluation of thermal discoloration. Then, light stability was calculated in accordance with the following equation.

[Light stability (%)]=[(Reflection density of the pellet after allowing to stand)/(Reflection density of the pellet before allowing to stand)×100]

The higher the value is, the greater the light stability

TABLE 14

| Experiment No. | Components of decolorizable toner (parts) Resin binder | Near infrared ray-absorbing dye | Decolorizing agent | Wax | Near infrared ray-reflecting or -absorbing material | Light fastness stabilizer (Metal soap) | Physical properties of decolorizable toner Thermal discoloration (—) | Light stability (%) |
|---|---|---|---|---|---|---|---|---|
| 29 | RE-2 (100) | DY-1 (2) | SE-1 (4) | WA-2 (3) | AD-5 (5) | MS-1 (0.3) | 1.41 | 77 |

TABLE 14-continued

| Experiment No. | Components of decolorizable toner (parts) Resin binder | Near infrared ray-absorbing dye | Decolorizing agent | Wax | Near infrared ray-reflecting or -absorbing material | Light fastness stabilizer (Metal soap) | Physical properties of decolorizable toner Thermal discoloration (−) | Light stability (%) |
|---|---|---|---|---|---|---|---|---|
| 30 | RE-2 (100) | DY-2 (2) | SE-2 (4) | WA-2 (3) | AD-5 (5) | MS-1 (0.1) | 1.35 | 75 |
| 31 | RE-3 (100) | DY-3 (2) | SE-3 (4) | WA-2 (3) | AD-5 (5) | MS-2 (1.0) | 1.43 | 76 |
| 32 | RE-3 (100) | DY-4 (2) | SE-4 (4) | WA-2 (3) | AD-5 (5) | MS-2 (4.0) | 1.45 | 81 |
| 33 | RE-2 (100) | DY-5 (2) | SE-1 (4) | WA-2 (5) | AD-5 (5) | MS-3 (5.0) | 1.51 | 82 |
| 34 | RE-2 (100) | DY-10 (2) | SE-2 (4) | WA-2 (5) | AD-5 (5) | MS-3 (0.5) | 1.43 | 76 |
| 35 | RE-3 (100) | DY-7 (2) | SE-3 (4) | WA-2 (2) | AD-5 (5) | MS-4 (3.0) | 1.47 | 72 |
| 36 | RE-3 (100) | DY-8 (2) | SE-4 (4) | WA-2 (2) | AD-5 (5) | MS-4 (2.0) | 1,46 | 75 |
| 37 | RE-2 (100) | DY-1 (2) | SE-1 (4) | WA-2 (3) | AD-5 (5) | MS-5 (3.0) | 1.46 | 77 |
| 38 | RE-2 (100) | DY-2 (2) | SE-2 (6) | WA-2 (5) | AD-5 (5) | MS-5 (3.0) | 1.45 | 65 |
| 39 | RE-3 (100) | DY-3 (2) | SE-3 (4) | WA-2 (3) | AD-5 (5) | MS-1 (0.05) | 1.33 | 71 |
| Comparative Experiment | | | | | | | | |
| 3 | RE-3 (100) | DY-7 (2) | SE-3 (4) | WA-2 (3) | AD-5 (5) | — | 0.71 | 30 |
| 4 | RE-3 (100) | DY-8 (2) | SE-4 (6) | WA-2 (3) | AD-5 (5) | — | 0.60 | 22 |

From the results shown in Table 14, it can be understood that when a metal soap is used as a light fastness stabilizer in the raw materials for toners, the raw materials are little discolored during kneading the raw materials with heating and have excellent light stability as is clear from Experiments 29 to 39 although the raw materials according to Comparative Experiments 3 and 4 are discolored during kneading.

[Experiments 40 and 41 and Comparative Experiment 5]

Raw materials shown in Tables 1 to 4 were weighed in a blending ratio shown in Experiments 43 and 44 or Comparative Experiment 5 of Table 15 so that the total amount could be 5150 to 5200 g. A mixer having an effective volume of 20 l, was charged with all of the raw materials, and the raw materials were blended together for 5 minutes while the temperature of the raw materials was adjusted to 25° to 30° C. in the mixer. The mixture was taken out from the mixer and a biaxial extruder was charged with the mixture. After the mixture was kneaded, the mixture was cooled to give a solidified product.

The solidified product was formed into a sample having a thickness of 2 mm by pressing the solidified product under a pressure of 700 kg.f/cm$^2$ using a hydraulic press.

As physical properties of the sample, image stabilities 1 to 4 were evaluated in accordance with the following methods. The results are shown in Table 15.

First of all, the obtained samples were allowed to stand for 120 minutes under a fluorescent lamp (illumination intensity: 1500 lux).

(A) Image stability 1

The density of color of the sample before allowing to stand and the density of color of the sample after allowing to stand are measured by using a Macbeth densitometer. The smaller the absolute value of the difference of density is, the smaller the degree of change of color is.

(B) Image stability 2

The value "L" of the sample before allowing to stand and the value "L" of the sample after allowing to stand are measured by using a Z-Σ90 COLOR MEASURING SYSTEM commercially available from NIPPON DENSYOKU KOGYO CO., LTD. The greater the difference is, the greater the degree of change of color is.

(C) Image stability 3

The value "a" of the sample before allowing to stand and the value "a" of the sample after allowing to stand are measured by using a Z-Σ90 COLOR MEASURING SYSTEM commercially available from NIPPON DENSYOKU KOGYO CO., LTD. The smaller the value is, the better the image stability is.

(D) Image stability 4

The value "b" of the sample before allowing to stand and the value of "b" the sample after allowing to stand are measured by using a Z-Σ90 COLOR MEASURING SYSTEM commercially available from NIPPON DENSYOKU KOGYO CO., LTD. The smaller the value is the better the image stability is.

TABLE 15

| Experiment No. | Components of decolorizable toner (parts) Resin binder | Near infrared ray-absorbing dye | De-colorizing agent | Wax | Light fastness stabilizer (Metal soap) | Physical properties of decolorizable toner No. of Image stability 1 0 min. | 1 120 min. | 2 0 min. | 2 120 min. | 3 0 min. | 3 120 min | 4 0 min. | 4 120 min |
|---|---|---|---|---|---|---|---|---|---|---|---|---|---|
| 40 | RE-5 (97) | DY-1 (2) | SE-1 (1) | WA-1 (3) | MS-1 (1) | 1.22 | 1.03 | 33.2 | 35.9 | −11.0 | −11.1 | −15.6 | −12.2 |
| 41 | RE-5 (97) | DY-1 (2) | SE-1 (1) | WA-1 (3) | MS-1 (0.5) | 1.07 | 0.85 | 38.3 | 42.9 | −14.9 | 14.4 | −20.1 | −13.5 |
| Comparative Experiment | | | | | | | | | | | | | |
| 5 | RE-5 (97) | DY-1 (2) | SE-1 (1) | WA-1 (3) | — | 0.95 | 0.61 | 42.7 | 54.8 | −15.7 | −13.6 | −17.3 | −4.3 |

From the results shown in Table 15, it can be understood that all of the decolorizable toners containing a metal soap as a light fastness stabilizer obtained in Experiments 40 and 41 have excellent image stability compared with the toner obtained in Comparative Experiment 5.

EXAMPLE 6

[Experiments 1 to 13 and Comparative Experiments 1 to 3]

Raw materials shown in Tables 1 to 3, 5 and 6 were blended m a blending ratio shown in Table 16 to give a uniformly blended mixture.

Then, 20 parts of the mixture and 80 parts of 1,1,2,2-tetrachloroethane were mixed together, and the mixture was sufficiently dissolved to or dispersed in the 1,1,2,2-tetrachloroethane to give a toner solution.

The toner solution was coated on a white copying paper with a brush so that a toner layer having a thickness of 20 to 30 μm in dry could be formed, and a solvent was vaporized to remove from the toner layer to give a sample.

As physical properties of the sample, yellowing resistance against irradiation of light and yellowing resistance against heat cycle were evaluated in accordance With the following methods. The results are shown in Table 16.

(Yellowing resistance against irradiation of light)

Near infrared rays were irradiated to the sample from a dichroic coat type halogen lamp (2 W/cm$^2$), which was placed at a distance of 20 cm from the sample, for 1 hour. After decolorizing the sample, a light having a wavelength of 300 to 400 nm, which was placed at a distance of 48 cm from the sample, was irradiated to the sample through a XENON LAMP FILTER commercially available from ATLAS CO., LTD. for 50, 100 or 500 hour. After that, yellowing of the sample was examined in accordance with JIS-B7754 by using a Canon fade meter. The yellowing resistance against irradiation of light of the sample was evaluated in accordance with the following criteria for evaluation.

[Criteria for evaluation]

A: No yellowing is observed in the sample when the light is irradiated to the sample for 500 hours.

B: No yellowing is observed in the sample when the light is irradiated to the sample for not less than 100 hours and less than 500 hours.

C: No yellowing is observed in the sample when the light is irradiated to the sample for not less than 50 hours and less than 100 hours.

D: Yellowing is observed in he sample until the light is irradiated to the sample for 50 hours.

[Yellowing resistance against heat cycle]

After a cycle of a procedure comprising irradiating near infrared rays to the sample in the same manner as in the procedure of the yellowing resistance against irradiation of light, reforming a toner layer on the sample, heating the sample at 80° C. for 10 minutes was repeated, yellowing resistance against heat cycle of the sample was evaluated in the same the manner as in the above-mentioned yellowing resistance against irradiation of light. The criteria for evaluation is as follows.

[Criteria for evaluation]

A: No yellowing is observed in the sample when the treatment is repeated not less than 50 cycles.

B: No yellowing is observed in the sample when the treatment is repeated not less than 20 cycles and less than 50 cycles.

C: Yellowing is observed in the sample when the treatment is repeated less than 20 cycles.

TABLE 16

| | Components of decolorizable toner (parts) | | | | | | Physical properties of decolorizable toner | |
|---|---|---|---|---|---|---|---|---|
| Experiment No. | Resin binder | Near infrared ray-absorbing dye | Decolorizing agent | Wax | Ultraviolet absorbing agent | Light fastness stabilizer (Heat-resistant age resistor | Yellowing resistance against irradiation of light | Yellowing resistance against heat cycle |
| 1 | RE-1 (100) | DY-1 (2) | SE-1 (2.84) | WA-1 (5) | UA-2 (1) | AO-1 (2) | A | A |
| 2 | RE-1 (100) | DY-1 (2) | SE-1 (2.84) | WA-1 (5) | UA-2 (1) | AO-1 (20) | A | A |
| 3 | RE-1 (100) | DY-1 (2) | SE-1 (2.84) | WA-1 (5) | UA-2 (1) | AO-2 (2) | A | A |
| 4 | RE-2 (100) | DY-2 (20) | SE-1 (5) | WA-1 (1) | UA-2 (0.5) | AO-3 (0.5) | A | B |
| 5 | RE-3 (100) | DY-3 (10) | SE-1 (10) | WA-1 (15) | UA-3 (25) | AO-4 (15) | A | A |
| 6 | RE-4 (100) | DY-4 (15) | SE-1 (10) | WA-1 (10) | UA-4 (15) | AO-4 (25) | A | A |
| 7 | RE-1 (100) | DY-5 (20) | SE-1 (10) | WA-1 (1) | UA-1 (2) | AO-1 (5) | A | A |
| 8 | RE-2 (100) | DY-6 (2) | SE-1 (10) | WA-1 (15) | UA-2 (10) | AO-2 (7) | A | A |
| 9 | RE-2 (100) | DY-7 (2) | SE-1 (10) | WA-1 (5) | UA-3 (20) | A2-2 (10) | A | A |
| 10 | RE-1 (100) | DY-8 (10) | SE-1 (20) | WA-1 (1) | UA-4 (15) | AO-1 (5) | A | A |
| 11 | RE-2 (100) | DY-1 (1) | SE-1 (20) | WA-1 (5) | UA-3 (1) | AO-2 (5) | A | A |
| 12 | RE-1 (100) | DY-1 (2) | SE-1 (2.84) | WA-1 (5) | UA-2 (2) | — | A | B |
| 13 | RE-2 (100) | DY-1 (2) | SE-1 (5.0) | WA-1 (5) | UA-4 (15) | — | A | B |
| Comparative Experiment | | | | | | | | |
| 1 | RE-1 (100) | DY-1 (2) | SE-1 (2.84) | WA-1 (5) | — | — | D | C |
| 2 | RE-2 (100) | DY-3 (15) | SE-1 (10) | WA-1 (10) | — | AO-1 (25) | C | A |
| 3 | RE-3 (100) | DY-1 (10) | SE-1 (10) | WA-1 (10) | — | AO-2 (25) | C | A |

From the results shown in Table 16, it can be understood that all of the decolorizable toners containing an ultraviolet absorbing agent obtained in Experiments 1 to 13 have excellent yellowing resistance against irradiation of light and yellowing resistance against heat cycle. In addition, when a heat-resistant age resistor is contained in the toner, it can be understood that yellowing resistance is more improved.

EXAMPLE 7

[Experiments 1 to 5]

A resin binder, a near infrared ray-absorbing dye, a decolorizing agent and electrically chargeable fine particles shown in Tables 1 to 3 and 6 were used.

In 75 parts of toluene was dissolved 20 parts of the resin binder, and the near infrared ray-absorbing dye and the decolorizing agent were dissolved therein or mixed therewith in an amount shown in Table 1 based on 100 parts of the resin binder to give a solution. Then, the toluene was removed from the solution to dry. After drying, obtained material was crudely ground, and the material was ground by using a LABO-JET MILL commercially available from NIPPON PNEUMATIC MFG. CO., LTD. to give toner particles having a weight average particle diameter of 10 μm. The electrically chargeable fine particles were mixed with the toner particles in a ratio shown in Table 17 based on 100 parts of the toner particles to give a mixture. The mixture was treated by using a HYBRIDIZATION SYSTEM NHS-0 commercially available from NARA MACHINERY CO., LTD. at a peripheral speed of 80 m/second for 3 minutes so that the electrically chargeable fine particles could be coated on the surface of the toner particles to give a toner.

As physical properties of the toner, electrically charged amount, printability, decolorizing property and light resistance were evaluated in accordance with the following methods. The results are shown in Table 17.

(Measuring method for electrically charged amount).

Electrically charged amount was evaluated according to a blow-off method.

After the toner and a FERRITE CARRIER FB-810 commercially available from KANTO DENKA KOGYO CO., LTD. were blended so that the concentration of the toner could be 5% by weight, the toner and the FERRITE CARRIER were uniformly dispersed, mixed and stirred to give a mixture. The electrically charged amount of the mixture was measured when the mixture was blown by using a BLOW-OFF TRIBO CHARGE METER TB-200 commercially available from TOSHIBA CHEMICAL CO., LTD. under a nitrogen gas pressure of 1.0 kg.f/cm$^2$ for 30 seconds.

(Measuring methods for printability, decolorizing property

A polypropylene bottle (volume: 500 ml) was charge with 5 parts of the toner and 95 parts of a NON-COAT COAT FERRITE CARRIER and they were mixed together by using a rotational system at a speed of rotation of 50 rpm for 30 minutes to give a developer (total weight: 300 g).

As a printing system, a laser beam printer KX-P4420 commercially available from KYUSYU MATSUSHITA ELECTRIC CO., LTD. was used and an external high pressure power source was used for a transfer power source and a developing bias power source, and the printing system was modified so that both a positively charged toner and a negatively charged toner could be used for printing by using the printing system.

Originally the above-mentioned printing system is suitable for the negatively charged toner, and a bias voltage of about −550 V and a transfer voltage of about 4000 V can be applied thereto. However, the printing system was modified so that the bias voltage of about −150 V and the transfer voltage of about −4000 V could applied thereto when the positively charged toner was used.

The above-mentioned bottle having the developer was fixed in the above-mentioned printing system in a usual method and 1000 sheets of paper were printed in accordance with a regular printing method.

(i) Printability

After 1000 sheets of paper were printed as mentioned above, the surface of the 1000th printed paper was observed with naked eyes under natural light. The state of printing was examined and evaluated in accordance with the following criteria for evaluation.

[Criteria for evaluation]

A: Colorability of printing is excellent and no fogging is observed in the printed paper.

B: Colorability of printing is good but fogging is observed a little in the printed paper.

C: Colorability of printing is bad and fogging is observed much in the printed paper.

(ii) Decolorizing property

After half of the 1000th printed paper was covered with an aluminum film and was laid on a hot plate at 70° C., the printed paper was allowed to stand for 3 minutes. Then, near infrared rays were irradiated to the printed paper for 8 seconds from an aluminum-coated halogen lamp for irradiation of near infrared rays (2 W/cm$^2$) which was placed at a distance of 30 cm from the printed paper, and the printed paper was observed with naked eyes and decolorizing property was evaluated in accordance with the following criteria for evaluation.

[Criteria for evaluation]

A: The toner is completely decolorized.

B: The color of the toner is slightly remained in the printed paper.

C: The toner is a little decolorized, but the remained color of the toner is obviously observed in the printed paper.

(iii) Light resistance

In the above-mentioned procedure for producing a printed paper, in order that toner particles were uniformly thinly extended over the paper and near infrared rays were uniformly and sufficiently irradiated, a non-fixed printed paper was produced. Near infrared rays were irradiated to the printed paper for 60 seconds from an aluminum-coated halogen lamp for irradiation of near infrared rays (0.2 W/cm$^2$), which was placed at a distance of 30 cm from the printed paper.

Then, the non-fixed printed paper to which near infrared rays were irradiated and the non-fixed printed paper to which near infrared rays were not irradiated were introduced into a fixing system to fix the printed matters. Difference of colorability of printed matters after fixing between the above-mentioned two non-fixed printed papers was observed with naked eyes, and evaluated in accordance with the following criteria for evaluation.

[Criteria for evaluation]

A: No difference of colorability is observed between the two.

B: A little difference of colorability is observed between the two.

C: Much difference of colorability is observed between the two.

[Experiments 6 to 10]

A resin binder, a near infrared ray-absorbing dye, a decolorizing agent and an electrically chargeable fine particles shown in Tables 1 to 3 and 6 were used.

The near infrared ray-absorbing dye and the decolorizing agent were added to the resin binder in a ratio shown in Table 17 based on 100 parts of the resin binder and they were dissolved in 200 parts of methylene chloride to give a solution. Then, the methylene chloride was removed from the solution. After an obtained material was coasely pulverized, the material was pulverized by using a LABO-JET MILL commercially available from NIPPON PNEUMATIC MFG. CO., LTD. to give toner particles having a weight average particle diameter of 10 μm. The electrically chargeable fine particles were mixed with the toner particles in a ratio shown in Table 17 based on 100 parts of the toner particles, and the electrically chargeable fine particles were coated on the surface of the toner particles in the same manner as in Experiment 1 of Example 7 to give a toner.

Physical properties of the toner were evaluated in the same manner as in Experiment 1 of Example 7. The results are shown in Table 17.

[Experiment 11]

A resin binder, a near infrared ray-absorbing dye, a decolorizing agent, an electrically chargeable fine particles and an electric charge regulator shown Tables 1 to 3, 5 and 6 were used In 200 pans of methylene chloride were dissolved 100 parts of the resin binder, 21 parts of the near infrared ray-absorbing dye, 1 part of the decolorizing agent and 2.7 parts of the electric charge regulator, and they were kneaded to give a solution. Then, the methylene chloride was removed from the solution. After an obtained material was coarsely pulverized, the material was pulverized by using a LABO-JET MILL commercially available from NIPPON PNEUMATIC MFG. CO., LTD. to give toner particles having a weight average particle diameter of 10 μm. With 100 parts of the toner particles were mixed 20 parts of the electrically chargeable fine particles, and the electrically chargeable fine particles were coated on the surface of the toner particles in the same manner as in Experiment 1 of Example 7 to give a toner.

Physical properties of the toner were evaluated in the same manner as in Experiment 1 of Example 7. The results are shown in Table 17.

[Comparative Experiment 1]

The procedure of Experiment 1 of Example 7 was repeated to give a toner except that the electrically chargeable fine particles were not coated on the surface or the toner particles.

Physical properties of the toner were evaluated in the same manner as in Experiment 1 of Example 7. The results are shown in Table 17.

[Comparative Experiment 2]

The procedure of Experiment 11 of Example 7 was repeated to give a toner except that the electrically chargeable fine particles were not coated on the surface of the toner particles.

Physical properties of the toner were evaluated in the same manner as in Experiment 11 of Example 7. The results are shown in Table 17.

TABLE 17

| | Components of decolorizable toner (parts) | | | | | Physical properties of decolorizable toner | | | |
|---|---|---|---|---|---|---|---|---|---|
| Experiment No. | Resin binder | Near infrared ray-absorbing dye | Decolorizing agent | Electric charge regulator | Electrically chargeable fine particles | Electrically charged amount (μC/g) | Print-ability | Decolorizing property | Light resistance |
| 1 | RE-24 (100) | DY-1 (5) | SE-1 (5) | — | TE-1 (20) | −22.0 | A | A | A |
| 2 | RE-24 (100) | DY-2 (5) | SE-1 (5) | — | TE-1 (20) | −21.4 | A | A | A |
| 3 | RE-24 (100) | DY-3 (5) | SE-5 (5) | — | TE-2 (10) | +18.1 | A | A | A |
| 4 | RE-24 (100) | DY-4 (5) | SE-4 (5) | — | TE-3 (10) | −17.6 | A | A | A |
| 5 | RE-24 (100) | DY-5 (5) | SE-6 (10) | — | TE-3 (10) | −18.6 | A | A | A |
| 6 | RE-24 (100) | DY-1 (2.1) | SE-1 (1) | — | TE-2 (10) | +17.4 | A | A | A |
| 7 | RE-24 (100) | DY-1 (2.1) | SE-1 (1) | — | TE-3 (15) | −13.3 | A | A | A |
| 8 | RE-24 (100) | DY-1 (2.1) | SE-1 (1) | — | TE-4 (10) | −21.3 | A | A | A |
| 9 | RE-24 (100) | DY-6 (2.1) | SE-1 (2) | — | TE-5 (10) | −16.9 | A | A | A |
| 10 | RE-24 (100) | DY-7 (2.1) | SE-5 (6) | — | TE-6 (10) | −18.3 | A | A | A |
| 11 | RE-24 (100) | DY-1 (2.1) | SE-1 (1) | CR-2 (2.7) | TE-1 (20) | −22.8 | A | A | A |
| Comparative Experiment | | | | | | | | | |
| 1 | RE-24 (100) | DY-1 (5) | SE-1 (5) | — | — | +3.1 | B | A | C |
| 2 | RE-25 (100) | DY-1 (2.1) | SE-1 (1) | CR-2 (2.7) | — | −2.0 | C | A | C |

From the results shown in Table 17, it is understood that all of the decolorizable toners obtained in Experiments 1 to 11 of Example 7 have excellent tribo-electrically charged amount, excellent printability, excellent decolorizing property and excellent light resistance.

EXAMPLE 8

In the following Experiments and Comparative Experiments, raw materials shown in Tables 1 to 3 and 5 were used.

[Experiment 1]

After 20 parts of a resin binder (RE-24) was dissolved in 75 parts of toluene, 2 parts of a near infrared ray-absorbing dye (DY-2) and 2 parts of a decolcorizing agent based on 100 parts of the resin binder were dissolved therein and mixed therewith. A solvent was vaporized therefrom to dry an obtained product. The dried product was coarsely pulverized, and further pulverized with a jet mill commercially available from NIPPON PNEUMATIC MFG. CO., LTD., and a toner having a weight average particle diameter of 11 μm was obtained. electric charge regulator having postively chargeable property was mixed in an amount of 1.5 parts based on 100 parts of the toner with the toner. The mixture was treated for 3 minutes at a peripheral speed of 80 m/second by using a HYBRIDIZATION SYSTEM commercially available from NARA MACHINERY CO., LTD. to cover the surface of the toner particles with the electric charge regulator. The obtained toner showed a blue color.

As physical properties of the obtained toner, tribo-electrically charged mount and decolorizing property were evaluated in accordance with the following methods. The results are shown in Table 18. (Tribo-electrically charged mount)

In accordance with a blow-off method, tribo-electrically charged mount was measured in the same manner as in Example 7.

(Decolorizing property)

The amount 4 parts of the toner was mixed with 100 parts of a silicone resin-coated carrier commercially available from POWDERTECH CO., LTD. under the trade name of F97-2535 to uniformly blended developer.

The obtained developer was provided in a copying machine commercially available from SANYO ELECTRIC CO., LTD. under the trade name of SFT-Z70, and a reproduction of an image was carried out using a test chart No. 1-R1975 prescribed by THE SOCIETY OF ELECTROGRAPHY OF JAPAN on a paper for plain paper copy.

After the obtained paper was irradiated for seconds with an aluminum-coated halogen lamp as a source of near infrared rays, the paper was adhered to a vertical wall, distinguishing was carried out at a distance from 5 m from the wall with naked eyes. Evaluation of decolorizing property was carried out in accordance with the following criteria for evaluation.

[Criteria for evaluation]

A: Color of the toner is completely disappeared.

B: Color of the toner is remained slightly.

C: Color of the toner is disappeared a little, but the existence of the toner is obviously observed.

D: Decolorizing of the toner is not observed.

[Experiment 2]

The procedure of Experiment 1 of Example 8 was carried out except that DY-3 as a near infrared ray-absorbing dye and SE-2 as a decolorizing agent were used to give CR-1-coated toner particles. The obtained toner showed a blue color.

As the physical properties of the obtained toner, tribo-electrically charged amount and decolorizing property were examined in the same manner as in Experiment 1 of Example 8. The results are shown in table 18.

[Experiment 3]

The procedure in Experiment 1 of Example 8 was carried out to give toner particles having a weight average particle diameter of 11 μm. After 2.0 parts of an electric charge regulator (CR-2) was mixed with 100 parts of the toner particles, and the surface of the toner particles was covered with CR-2 in the same manner as in Experiment 1 of Example 8.

As the physical properties of the obtained toner, tribo-electrically charged amount and decolorizing property were evaluated in the same mariner as in Experiment 1 of Example 8. The results are shown in Table 18.

[Experiment 4]

The amount 100 parts of a resin binder (RE-24), 2 parts of a near infrared ray-absorbing dye (DY-2) and 2 parts of a decolorizing agent (SE-1) were mixed with 200 parts of methylene chloride, and the mixture was headed. Then, the methylene chloride was removed from the mixture. After the product was coarsely pulverized, the product was pulverized with a jet mill to give toner particles having a weight average particle diameter of 11 μm.

The amount 100 parts of the toner particles and 3 parts of CR-3 were mixed together, and the mixture was treated for 3 minutes at a peripheral speed of 80 m/second by using a HYBRIDIZATION SYSTEM commercially available from NARA MACHINERY CO., LTD. to cover the surface of the toner particles with CR-3. The obtained toner showed a blue color.

As the physical properties of the obtained toner, tribo-electrically charged amount and decolorizing property were evaluated in the same manner as in Experiment 1 of Example 8. The results are shown in Table 18.

[Experiment 5]

To 100 parts of toner particles having a weight average particle diameter of 11 μm prepared in the same manner as in Experiment 4 of Example 8, a solution prepared dispersing 1.5 parts of an electric charge regulator in 20 parts of methanol was added and stirred. The mixture was dried in a FLOW COATER MULT-PURPOSE commercially available from NARA MACHINERY CO., LTD. at a temperature of the inside of apparatus of 55° C. for 30 minutes, to homogeneously cover the surface of the toner particles with CR-4 to give a toner. The obtained toner showed a blue color.

As the physical properties of the obtained toner, tribo-electrically charged amount and decolorizing property were evaluate in the same manner as in Experiment 1 of Example 8. The results are shown in Table 18.

[Experiments 6 to 18]

The procedure of Experiment 1 of Example 8 was carried out except that as raw materials, a resin binder, a near infrared ray-absorbing dye, a decolorizing agent and an electric charge regulator shown in Tables 1 to 3 and 5 were used in a ratio shown in Table 18. The surface of the toner was covered with the electric charge regulator in the same manner as in Experiment 1 of Example 8.

As the physical properties of the obtained toner, tribo-electrically charged amount and decolorizing property were evaluated in the same manner as in Experiment 1 of Example 8. The results are shown in Table 18.

[Comparative Experiment 1]

After 20 parts of a resin binder (RE-24) was dissolved in 75 parts of toluene, 2 parts of a near infrared ray absorbing dye (DY-2), 2 parts of a decolorizing agent (SE-1) and 1.5 parts of an electric charge regulator having a positively chargeable property were dissolved in 100 parts of the resin binder, and mixed therewith so that the mixture was homogeneously mixed. Then, the solvent was removed from the solution, and the obtained product was dried. After the dried product was coarsely pulverized, the product was further pulverized with a jet mill to give a toner having a weight average particle diameter of 11 μm in which the electric charge regulator (CR-1) was contained. The obtained toner showed a blue color.

As the physical properties of the obtained toner, tribo-electrically charged amount and decolorizing property were evaluated in the same manner as in Experiment 1 of Example 8. The results are shown in Table 18.

The copied image had much fogging, and was not a suitable one.

[Comparative Experiment 2]

With 100 parts of a resin binder, 2 parts of a near infrared ray-absorbing dye (DY-2), 2 parts of a decolorizing agent (SE-2) and 1.5 parts of an electric charge regulator, 200 parts of methylene chloride was mixed. After the mixture was molten and kneaded, methylene chloride was removed from the mixture. The product was coarsely pulverized and then pulverized with a jet mill to give a toner having a weight average particle diameter of 11 μm in which the electric charge regulator was contained. The obtained toner showed a blue color.

As the physical properties of the obtained toner, tribo-electrically charged mount and decolorizing property were evaluated in the same manner as in Experiment 1 of Example 8. The results are shown in Table 18.

The copied image had much fogging, and was not a suitable one.

[Comparative Experiments 3 to 6]

The procedure of Experiment 1 of Example 8 was carried out except that as raw materials, a resin binder, a near infrared ray-absorbing dye, a decolorizing agent and an electric charge regulator shown in Tables 1 to 3 and 5 were used in a ratio shown in Table 18. A toner in which an electric charge regulator was contained was obtained in the same manner as in Comparative Experiment 1 of Example 8.

As the physical properties of the obtained toner, tribo-electrically charged amount and decolorizing property were evaluated in the same manner as in Experiment 1 of Example 8. The results are shown in Table 18.

The copied image had much fogging, and was not a suitable one.

TABLE 18

| Experiment No. | Components of decolorizable toner (parts) | | | | Physical properties of decolorizable toner | |
|---|---|---|---|---|---|---|
| | Resin binder | Near infrared ray-absorbing dye | Decolorizing agent | Electric charge regulator | Tribo-electrically charged amount (μC/g) | Decolorizing property |
| 1 | RE-24 (100) | DY-2 (2) | SE-1 (2) | CR-1 (1.5) | +22.0 | A |
| 2 | RE-24 (100) | DY-3 (2) | SE-2 (2) | CR-1 (1.5) | +20.3 | A |
| 3 | RE-24 (100) | DY-2 (2) | SE-1 (2) | CR-2 (2.0) | −17.5 | A |
| 4 | RE-24 (100) | DY-2 (2) | SE-1 (2) | CR-3 (2.5) | −22.3 | A |
| 5 | RE-24 (100) | DY-2 (2) | SE-1 (2) | CR-4 (1.5) | +26.3 | A |
| 6 | RE-24 (100) | DY-2 (2) | SE-1 (2) | CR-5 (2.5) | +30.8 | A |
| 7 | RE-25 (100) | DY-2 (2) | SE-1 (2) | CR-1 (1.5) | +21.6 | A |
| 8 | RE-25 (100) | DY-3 (2) | SE-2 (2) | CR-1 (1.5) | +19.8 | A |
| 9 | RE-25 (100) | DY-2 (2) | SE-1 (2) | CR-2 (2.0) | −17.0 | A |
| 10 | RE-25 (100) | DY-2 (2) | SE-1 (2) | CR-3 (2.5) | −24.1 | A |
| 11 | RE-25 (100) | DY-2 (2) | SE-1 (2) | CR-4 (1.5) | +25.5 | A |
| 12 | RE-25 (100) | DY-2 (2) | SE-1 (2) | CR-5 (2.5) | +28.6 | A |
| 13 | RE-24 (100) | DY-1 (2) | SE-1 (2) | CR-1 (1.5) | +21.5 | A |
| 14 | RE-24 (100) | DY-4 (2) | SE-1 (2) | CR-1 (1.5) | +20.8 | A |
| 15 | RE-25 (100) | DY-5 (2) | SE-2 (2) | CR-2 (2.0) | −17.9 | A |
| 16 | RE-25 (100) | DY-6 (2) | SE-3 (2) | CR-3 (2.5) | −23.2 | A |
| 17 | RE-26 (100) | DY-7 (2) | SE-3 (2) | CR-4 (1.5) | +24.6 | A |
| 18 | RE-26 (100) | DY-8 (2) | SE-4 (2) | CR-5 (2.5) | +29.8 | A |
| Comparative Experiment | | | | | | |
| 1 | RE-24 (100) | DY-2 (2) | SE-1 (2) | CR-1 (1.5) | +6.1 | D |
| 2 | RE-25 (100) | DY-3 (2) | SE-2 (2) | CR-1 (1.5) | +5.2 | D |
| 3 | RE-24 (100) | DY-2 (2) | SE-1 (2) | CR-2 (2.0) | −3.8 | D |
| 4 | RE-24 (100) | DY-2 (2) | SE-1 (2) | CR-3 (2.5) | −4.1 | D |
| 5 | RE-24 (100) | DY-2 (2) | SE-1 (2) | CR-4 (1.5) | +7.6 | D |
| 6 | RE-24 (100) | DY-2 (2) | SE-1 (2) | CR-5 (2.5) | +9.2 | D |

From the results shown in Table 18, all of the toners obtained in Experiments 1 to 18 have excellent electrically charging property and excellent decolorizing property.

Example 9

[Experiments 1 to 10]

A pressure kneader was charged with a resin binder A, a near infrared ray-absorbing dye, a decolorizing agent and a wax in a ratio shown in Table 19. After the mixture was heated to a temperature shown in Table 19 and kneaded so that the mixture was homogeneously dispersed, an obtained product was cooled to room temperature to give a kneaded material.

After the kneaded material was pulverized with a hammer mill so that the particle diameter was at most about 5 mm, a pressure kneeder was charged with the pulverized material together with a resin binder B having an average particle diameter of at most about 10 mm as shown in Table 1. When the temperature was attained to the temperature shown in Table 19, the mixture was kneaded with heating at that temperature for the time shown in Table 19. After the product was taken out from the pressure kneader and cooled to room temperature, the cooled product was pulverized with a hammer mill to give a decolorizable toner.

As the physical properties of the obtained toner, colorability, decolorizing property, dispersibility, concentration of image and offset resistance were evaluated in accordance with the following methods. The results are shown in Table 19.

(A) Colorability

The toner was placed on the sample table, the surface color was measured with a Z-Σ90 COLOR MEASURING SYSTEM commercially available from NIPPON DENSYOKU KOGYO CO., LTD., and the colorability was evaluated in accordance with the following criteria for evaluation. In the values of L. a. b. color elements, the value of "b" was adopted as the color of the decolorizable toner.

The smaller the value of "b" is, the greater the blue color becomes. The greater the value "b" is, the greater the yellow color becomes. When the value of "b" is zero, the color is gray.

[Criteria for evaluation]

A: The value of "b" is not more than −10.

B: The value of "b" is more than −10 and not more than 3.

C: The value of "b" is more than 3.

(B) Decolorizing property

The amount 4 parts of the toner was blended with 100 parts of a silicone resin-coated carrier commercially available from POWDERTECH CO., LTD. under the trade name of F97-2535, and they were uniformly dispersed to give a developer.

The obtained developer was set in a copying machine SFT-Z70 commercially available from SANYO ELECTRIC CO., LTD. and the reproduction of an image was carried out using a test chart No. 1-R1975 prescribed by THE SOCIETY OF ELECTROGRAPHY OF JAPAN on a paper for plain paper copy.

After near infrared rays were irradiated to the obtained paper at a distance of 30 cm from the paper for 5 seconds with an aluminum-coated halogen lamp, decolorizing property was evaluated with naked eyes in accordance with the following criteria for evaluation.

[Criteria for evaluation]

A: Color is completely disappeared, and yellowing is not generated.

B: It takes at least 5 seconds for decolorizing the toner, but yellowing is not occurred.

C: Yellowing is observed.

(C) dispersibility

The toner was coarsely pulverized with a hammer mill so that its particle diameter is at most 5 mm or so and bonded with an epoxy resin. The product was sliced with a microtome to give a film, and the part of the decolorizable toner was observed by means of a microscope under visible light. The dispersibility was evaluated in accordance with the following criteria for evaluation.

[Criteria for evaluation]

A: Both the near infrared ray-absorbing dye and the decolorizing agent are not coagulated.

B: Agglomerate is observed, but the agglomerate of at least 1 μm is not existed.

C: Agglomerate is observed, but the agglomerate of at least 3 μm is not existed.

D: Agglomerate of more than 3 μm is existed.

(D) Concentration of image

Concentration of image was measured using a colored filter by means of a Macbeth reflection densitometer and evaluated in accordance with the following criteria for evaluation.

[Criteria for evaluation]

A: The measured value is at least 0.9.

B: The measured value is at least 0.8 and less than 0.9.

C: The measured value is at least 0.6 and less than 0.8.

D: The measured value is less than 0.6.

(E) Offset resistance

Twenty sheets of paper were reproduced by means of a copying machine commercially available from SANYO ELECTRIC CO., LTD. in which a silicone oil-impregnated cleaning pad of a fixing roller was removed, and the number of offset-generated papers was counted and evaluated in accordance with the following criteria for evaluation.

[Criteria for evaluation]

A: Number of offset-generated papers is zero.

B: Number of offset-generated papers is 1 or 2.

C: Number of offset-generated papers 3 or 4.

D: Number of offset-generated papers is at least 5.

[Comparative Experiments 1 and 2]

A pressure kneeder was charged with a resin binder B, a near infrared ray-absorbing dye and a decolorizing agent without a resin binder A, and they were kneaded in conditions shown in Table 19. After the mixture was heated and kneaded for 5 minutes (Comparative Experiment 1) or 1 minute (Comparative Experiment 2) at a temperature shown in Table 19, the mixture was cooled to room temperature, and a product was obtained.

The obtained product was pulverized with a hammer mill to give a decolorizable toner having an average particle diameter of about 12 μm.

The physical properties of the obtained toner was evaluated in the same manner as in Experiments 1 to 10 of Example 9. The results are shown in Table 19.

TABLE 19

| | Conditions for preparing molten kneaded material | | | | | Conditions for preparing decolorizable toner | | |
|---|---|---|---|---|---|---|---|---|
| Experiment No. | Resin binder (parts) | Near infrared-ray absorbing dye (parts) | Decolorizing agent (parts) | Wax (parts) | Kneading temperature (°C.) | Resin binder B (parts) | Heating temperature (°C.) | Heating time (min) |
| 1 | REA-1 (20) | DY-1 (2) | SE-1 (2) | WA-1 (3) | 110 | REB-1 (80) | 130 | 1 |
| 2 | REA-2 (20) | DY-1 (2) | SE-1 (2) | WA-1 (3) | 110 | REB-1 (80) | 130 | 1 |
| 3 | REA-3 (20) | DY-1 (2) | SE-1 (2) | WA-1 (3) | 110 | REB-1 (80) | 130 | 1 |
| 4 | REA-1 (20) | DY-2 (10) | SE-2 (10) | — | 110 | REB-2 (80) | 130 | 1 |
| 5 | REA-2 (20) | DY-3 (20) | SE-2 (20) | — | 110 | REB-1 (80) | 130 | 1 |
| 6 | REA-3 (20) | DY-4 (20) | SE-2 (20) | — | 110 | REB-2 (80) | 130 | 1 |
| 7 | REA-1 (30) | DY-5 (2)) | SE-4 (2) | WA-1 (3) | 110 | REB-3 (70) | 130 | 1 |
| 8 | REA-2 (40) | DY-6 (20) | SE-4 (20) | WA-1 (3) | 110 | REB-3 (60) | 130 | 1 |
| 9 | REA-3 (50) | DY-7 (2) | SE-4 (2) | WA-1 (3) | 110 | REB-3 (50) | 130 | 1 |
| 10 | REA-4 (60) | DY-8 (2) | SE-1 (2) | WA-1 (3) | 110 | REB-1 (40) | 130 | 1 |
| Comparative Experiment | | | | | | | | |
| 1 | REA-1 (100) | DY-1 (2) | SE-1 (2) | WA-1 (3) | 130 | — | — | — |
| 2 | REA-2 (100) | DY-1 (2) | SE-1 (2) | WA-1 (3) | 110 | — | — | — |

| Experiment | Physical properties of decolorizable toner | | | | |
|---|---|---|---|---|---|
| No. | Colorability | Decolorizing property | Dispersibility | Concentration of image | Offset resistance |
| 1 | A | A | A | A | A |
| 2 | A | A | A | A | A |
| 3 | A | A | A | A | A |
| 4 | A | A | A | A | A |
| 5 | A | A | A | A | A |
| 6 | A | A | A | A | A |
| 7 | A | A | A | A | A |
| 8 | A | A | A | A | A |
| 9 | A | A | A | A | A |
| 10 | A | A | A | A | A |

TABLE 19-continued

| Comparative Experiment | | | | | |
|---|---|---|---|---|---|
| 1 | C | C | A | D | A |
| 2 | A | B | A | A | D |

From the results shown in Table 19, it can be understood that a decolorizable toner having excellent colorability, excellent decolorizing property, excellent dispersibility, excellent concentration of image and excellent offset resistance at a time can be obtained in accordance with the above method.

[Preparation Example 1 of Master Batch (Preparation No. MB-1 to 8)]

A first solution and a second solution were prepared by mixing the raw materials shown in Tables 1, 2 and 4 to 6 in a mixing ratio shown in Table 20.

After the first solution and the second solution were mixed together, an organic solvent was removed from the solution under a reduced pressure to give a mass.

The mass was then pulverized for 50 hours by using a ball mill to give a master batch.

TABLE 20

| Preparation No. | Components of first solution (parts) | | Components of second solution (parts) | | |
|---|---|---|---|---|---|
| | Resin binder | Organic solvent | Near infrared ray-absorbing dye | Light fastness stabilizer | Organic solvent |
| UB-1 | RE-1 (10) | SO-1 (50) | DY-1 (2) | AO-7 (2) | SO-1 (50) |
| MB-2 | RE-5 (10) | SO-2 (50) | DY-2 (2) | MS-1 (0.5) | SO-2 (50) |
| MB-3 | RE-6 (10) | SO-3 (50) | DY-1 (2) | — | SO-3 (50) |
| MB-4 | RE-7 (10) | SO-4 (50) | DY-3 (2) | — | SO-4 (50) |
| MB-5 | RE-8 (10) | SO-1 (50) | DY-1 (2) | — | SO-1 (50) |
| MB-6 | RE-1 (10) | SO-1 (50) | DY-1 (2) | AO-6 (3) | SO-1 (50) |
| MB-7 | RE-5 (10) | SO-5 (50) | DY-2 (2) | AO-11 (1) | SO-5 (50) |
| MB-8 | RE-1 (10) | SO-1 (50) | DY-1 (2) | OA-1 (5) | SO-2 (50) |

[Preparation Example 2 of Master Batch (Preparation No. MB-9 to 17)]

The raw materials shown in Tables 1, 2 and 5 were blended together in a blending ratio shown in Table 21 and heated to melt and kneaded at a temperature of 130° C. by using a biaxial extruder commercially available from IKEGAl CORP. under the trade name of PCM-30.

As to Preparation Nos. MB-16 and 17, the obtained kneaded molten material was used as a master batch as it was.

As to Preparation Nos. MB-9 to 15, the obtained kneaded molten material was cooled to give a mass, and the mass was pulverized for 50 hours with a ball mill to give a master batch.

TABLE 21

| Preparation No. | Components of master batch (parts) | | |
|---|---|---|---|
| | Resin binder | Near infrared ray-absorbing dye | Light fastness stabilizer |
| MB-9 | RE-1 (10) | DY-1 (2) | AO-7 (2) |
| MB-10 | RE-6 (10) | DY-2 (2) | — |
| MB-11 | RE-7 (10) | DY-1 (2) | — |
| MB-12 | RE-8 (10) | DY-3 (2) | — |
| MB-13 | RE-1 (10) | DY-1 (2) | AO-6 (2) |
| MB-14 | RE-5 (10) | DY-2 (2) | AO-6 (2) |
| MB-15 | RE-5 (10) | DY-4 (2) | AO-11 (1) |
| MB-16 | RE-7 (10) | DY-1 (2) | — |
| MB-17 | RE-1 (10) | DY-3 (2) | AO-7 (3) |

EXAMPLE 10

[Experiments 1 to 20]

In accordance with the adding method of a master batch shown in Table 22, the raw materials shown in Tables 1, 3 and 4 and the master batch obtained in Preparation Nos. MB-1 to 17 were heated to melt and kneaded at a temperature of 130° C. with a kneader shown in Table 22. In Table 22. EX denotes a biaxial kneading extruder and KN denotes a pressure kneader. After that, the kneaded molten material was cooled to give a mass and the mass was pulverized with a cutter mill and a jet mill to give a pulverized material. The pulverized material was classified with a wind-force classifier to give a toner having a particle diameter of 5 to 20 μm.

The meanings of the adding methods of a master batch 1 to 4 are as follows.

(Adding method of a master batch 1) decolorizing were uniformly mixed together with a kneader, the mixture was heated to melt and kneaded with a biaxial kneader or a pressure kneader.

(Adding method of a master batch 2)

The master batch was introduced into the component for decolorizing while kneading and heating to melt the component for decolorizing with a biaxial kneader so that they were mixed in a prescribed ratio.

(Adding method of a master batch 8)

The component for decolorizing was heated to melt B and kneaded for 10 minutes, and the master batch was added thereto. Then, they were heated to melt and kneaded.

(Adding method of a master batch 4)

The component for decolorizing was heated to melt and kneaded with a first biaxial kneader.

The master batch was heated to melt and kneaded with a second biaxial kneader.

The molten master batch was introduced into the first biaxial kneader so that they were mixed in a prescribed ratio.

TABLE 22

| Experiment No. | Components of decolorizable toner (parts) | | | | | |
|---|---|---|---|---|---|---|
| | Component for decolorizing | | | | | |
| | Resin binder | Decolorizing agent | Wax | Near infrared ray-reflecting or -absorbing material | Master batch | Method for adding master batch |
| 1 | RE-1 (90) | SE-1 (3) | WA-1 (3) | AD-5 (5) | MB-1 (10) | 1 |
| 2 | RE-1 (90) | SE-2 (5) | WA-1 (3) | AD-5 (5) | MB-2 (7) | 1 |
| 3 | RE-1 (90) | SE-1 (6) | WA-1 (3) | AD-5 (5) | MB-3 (10) | 1 |
| 4 | RE-1 (90) | SE-1 (2) | WA-1 (5) | AD-5 (5) | MB-4 (7) | 1 |
| 5 | RE-1 (90) | SE-1 (1) | WA-1 (3) | AD-5 (5) | MB-5 (10) | 2 |
| 6 | RE-1 (90) | SE-2 (0.5) | WA-1 (4) | AD-5 (5) | MB-6 (10) | 2 |
| 7 | RE-1 (90) | SE-2 (3) | WA-1 (3) | AD-5 (5) | MB-7 (5) | 3 |
| 8 | RE-1 (90) | SE-4 (4) | WA-1 (5) | AD-5 (5) | MB-8 (10) | 3 |
| 9 | RE-1 (90) | SE-4 (2) | WA-1 (3) | AD-5 (5) | MB-9 (10) | 1 |
| 10 | RE-5 (90) | SE-1 (3) | WA-1 (2) | AD-5 (5) | MB-10 (10) | 1 |
| 11 | RE-5 (90) | SE-4 (2) | — | AD-5 (5) | MB-11 (5) | 1 |
| 12 | RE-5 (90) | SE-1 (5) | WA-1 (5) | AD-5 (5) | MB-12 (10) | 1 |
| 13 | RE-5 (90) | SE-1 (2) | WA-1 (3) | AD-5 (5) | MB-13 (10) | 2 |
| 14 | RE-5 (90) | SE-2 (5) | WA-1 (3) | AD-5 (5) | MB-14 (10) | 2 |
| 15 | RE-5 (90) | SE-3 (2) | WA-1 (3) | AD-5 (5) | MB-15 (10) | 3 |
| 16 | RE-5 (90) | SE-1 (4) | WA-1 (6) | AD-5 (5) | MB-16 (10) | 3 |
| 17 | RE-5 (90) | SE-1 (1) | WA-1 (5) | AD-5 (5) | MB-17 (10) | 3 |
| 18 | RE-5 (90) | SE-3 (1) | WA-1 (4) | AD-5 (5) | MB-16 (10) | 4 |
| 19 | RE-5 (90) | SE-2 (6) | WA-1 (3) | AD-5 (5) | MB-16 (10) | 4 |
| 20 | RE-5 (90) | SE-3 (4) | WA-1 (2) | AD-5 (5) | MB-17 (10) | 4 |

| Experiment No. | Kneader | | Physical properties of decolorizable toner | | |
|---|---|---|---|---|---|
| | First process | Second process | Discoloration resistance | Light stability | Decolorizing property |
| 1 | EX | — | A | A | A |
| 2 | EX | — | A | A | A |
| 3 | KN | — | A | A | A |
| 4 | KN | — | A | A | A |
| 5 | EX | — | A | A | A |
| 6 | EX | — | A | A | A |
| 7 | KN | — | A | A | A |
| 8 | KN | — | A | A | A |
| 9 | EX | — | A | A | A |
| 10 | KN | — | A | A | A |
| 11 | EX | — | A | A | A |
| 12 | KN | — | A | A | A |
| 13 | EX | — | A | A | A |
| 14 | EX | — | A | A | A |
| 15 | KN | — | A | A | A |
| 16 | KN | — | A | A | A |
| 17 | KN | — | A | A | A |
| 18 | EX | EX | A | A | A |
| 19 | EX | EX | A | A | A |
| 20 | EX | EX | A | A | A |

To 100 parts of the obtained toner, 0.1 part of finely powdered silica commercially available from NIPPON AEROSIL CO., LTD. under the trade name of Aerosil R-972 was added, and they were blended to give a mixture.

The mixture was then blended with a carrier commercially available from POWDERTECH CO., LTD. under the trade name of F883-1025 so that the content of the toner was 7% by weight to give a two-component type developer.

A black solid was used as a manuscript and a reproduction of the black solid was carried out with the obtained two-component type developer by means of an electrostatic reproduction machine commercially available from RICOH COMPANY, LTD. under the trade name of FT-4525. After that, the reproduction print was set in a tray for paper, and the reproduction was again carried out so that the printed image was superposed on the image-printed portion. The Macbeth density of the printed image was compared with that of the previously printed image, and the procedure was reciprocated so that the difference became ±0.05. When the difference of the Macbeth density was ±0.05, the printed paper was used as a sample.

As the physical properties of the toner, discoloration resistance, light stability and decolorizing property of the sample were examined in accordance with the following methods. The results are shown in Table 22.

(Discoloration resistance)

The toner was formed into a plate having a thickness of about 2 mm and a diameter of about 50 mm by using an oil press, and the reflection density of the plate was measured with a Macbeth densitometer for points of the plate.

The average was measured and the discoloration resistance was evaluated in accordance with the following criteria for evaluation.

[Criteria for evaluation]

A: Reflection density is at least 1.10.

B: Reflection density is at least 0.91 and less than 1.10.

C: Reflection density is at least 071 and less than 0.91.

D: Reflection density is less than 0.71.

(Light stability)

The reflection density A of the sample was measured with a Macbeth densitometer. After the sample was allowed to stand for 24 hours under a fluoroescent lamp (illumination intensity: 1500 lux) the reflection density B was measured in the same manner as the above. The light stability was calculated in accordance with the following equation.

[Light stability]=(Reflection density B)/(Reflection density A)×100 of 130° C. In Table 23, EX denotes a biaxial heading extruder and KN denotes a pressure header. After that, the kneaded molten material was cooled to give a mass and the mass was pulverized with a cutter mill and a jet mill to give a pulverized material. The pulverized material was then classified with a wind-force classifier to give a toner having a particle diameter of 5 to 20 μm.

The physical properties of the toner were examined in the same manner as in Experiments 1 to 20 of Example 10.The results are shown in Table 23.

TABLE 23

| | Components of decolorizable toner (parts) | | | | | | | Physical properties of decolorizable toner | | |
|---|---|---|---|---|---|---|---|---|---|---|
| Comparative Experiment No. | Resin binder | Near infrared ray-absorbing dye | De-colorizing agent | Wax | Light fastness stabilizer | Near infrared ray-reflecting or -absorbing material | Kneader | Dis-coloration resistance | Light stability | Decolor-izing property |
| 1 | RE-1 (100) | DY-1 (2) | SE-1 (3) | WA-1 (3) | AO-7 (2) | AD-5 (5) | EX | C | B | A |
| 2 | RE-1 (100) | DY-1 (2) | SE-2 (3) | WA-1 (2) | MS-1 (0.5) | AD-5 (5) | EX | C | B | A |
| 3 | RE-5 (100) | DY-2 (2) | SE-1 (5) | WA-1 (3) | AO-7 (3) | AD-5 (5) | KN | D | C | A |
| 4 | RE-5 (100) | DY-2 (2) | SE-3 (3) | WA-1 (5) | AO-6 (4) | AD-5 (5) | EX | C | B | A |
| 5 | RE-1 (100) | DY-1 (2) | SE-1 (2) | WA-1 (1) | AO-11 (3) | AD-5 (5) | KN | C | B | A |
| 6 | RE-1 (100) | DY-1 (2) | SE-4 (7) | WA-1 (2) | AO-6 (2) | AD-5 (5) | KN | D | C | A |
| 7 | RE-6 (100) | DY-3 (2) | SE-1 (4) | WA-1 (5) | — | AD-5 (5) | EX | A | A | D |
| 8 | RE-7 (100) | DY-3 (2) | SE-2 (4) | WA-1 (3) | — | AD-5 (5) | EX | A | A | D |
| 9 | RE-8 (100) | DY-1 (2) | SE-1 (5) | WA-1 (3) | — | AD-5 (5) | EX | A | A | D |
| 10 | RE-1 (90) RE-6 (10) | DY-1 (2) | SE-4 (2) | WA-1 (4) | — | AD-5 (5) | EX | B | B | A |
| 11 | RE-1 (90) RE-7 (10) | DY-4 (2) | SE-1 (4) | WA-1 (4) | — | AD-5 (5) | EX | B | B | A |
| 12 | RE-1 (90) RE-8 (10) | DY-4 (2) | SE-3 (4) | WA-1 (4) | — | AD-5 (5) | EX | B | B | A |
| 13 | RE-1 (100) | DY-1 (2) | SE-1 (4) | WA-1 (3) | AO-7 (10) | AD-5 (5) | EX | A | A | D |
| 14 | RE-5 (100) | DY-1 (2) | SE-2 (4) | WA-1 (3) | AO-6 (15) | AD-5 (5) | EX | A | A | D |
| 15 | RE-1 (100) | DY-1 (2) | SE-3 (4) | WA-1 (3) | AO-11 (10) | AD-5 (5) | EX | A | A | D |
| 16 | RE-1 (100) | DY-1 (2) | SE-1 (4) | WA-1 (3) | — | AD-5 (5) | EX | D | D | A |

The light stability was evaluated accordance with the following criteria for evaluation.

[Criteria for evaluation]

A: Reflection density is at least 80%.

B: Reflection density is at least 61% and less than 80%.

C: Reflection density is at least 41% and less than 61%.

D: Reflection density is less than 41%.

(Decolorizing property)

The sample was allowed to stand in a thermostatic chamber of 60° C. while irradiating a light with an aluminum-coated halogen lamp at a distance of 10 cm from the sample. The sample was observed with naked eyes from the window of the chamber, and the time when the color of the toner was disappeared was measured by three men.

The average decolorizing property was evaluated in accordance with the following criteria for evaluation.

[Criteria for evaluation]

A: Decolorizing time is less than 10 seconds.

B: Decolorizing time is at least 10 seconds and less than 30 seconds.

C: Decolorizing time is at least 30 seconds and less than 60 seconds.

D: Decolorizing time is at least 60 seconds or the color is not disappeared.

[Comparative Experiments 1 to 16]

The raw material shown in Tables 1 to 5 were mixed together in a blending ratio shown in Table 23 with a header and heated to melt and headed at a temperature As is clear from the results shown in Tables 22 and 23, it can be understood that the toners obtained in Experiments 1 to 20, which were prepared by using previously prepared master batches have remarkably excellent physical properties in comparison with the toners of Comparative Experiments 1 to 16, which were prepared by heating to melt and heading at a time raw materials for a toner.

Also, it can be understood that when a resin binder having a polar group is used an obtained toner shows improved excellent physical properties as well as a toner not containing a resin binder having a polar group even through a light fastness stabilizer is not used.

In addition to the ingredients uses in the Examples, other ingredients can be used in the Examples as set forth in the specification to obtain substantially the same results.

What is claimed is:

1. A process for preparing a decolorizable toner comprising (A) a resin binder, (B) at least one near infrared ray-absorbing dye selected from the group consisting of a near infrared ray-absorbing dye represented by the general formula (I):

$$X^-.Y^+$$

wherein X is a halogen ion, perchloric acid ion, $PF_6^-$, $SbF_6^-$, $OH^-$, sulfonic acid ion or $B_4^-$, $Y^+$ is a cation having absorptions in the near infrared region, and a near infrared ray-absorbing dye represented by the general formula (II):

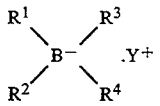

(II)

wherein each of $R^1$, $R^2$, $R^3$ and $R^4$ is independently hydrogen atom, a hydrocarbon group or a hydrocarbon group containing a hetero atom, $Y^+$ is the same as defined above, (C) a decolorizing agent represented by the general formula (III):

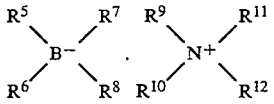

(III)

wherein each of $R^5$, $R^6$, $R^7$ and $R^8$ is independently an alkyl group, an aryl group, an allyl group, an aralkyl group, an alkenyl group, an alkynyl group, silyl group, an alicyclic group, a substituted alkyl group, a substituted aryl group, a substituted allyl group, a substituted aralkyl group, a substituted alkenyl group, a substituted alkynyl group or a substituted silyl group, with the proviso that at least one of $R^5$, $R^6$, $R^7$ and $R^8$ is an alkyl group having 1 to 12 carbon atoms; and each of $R^9$, $R^{10}$, $R^{11}$ and $R^{12}$ is independently hydrogen atom, an alkyl group, an aryl group, an allyl group, an aralkyl group, an alkenyl group, an alkynyl group, an alicyclic group, a substituted alkyl group, a substituted aryl group, a substituted allyl group, a substituted aralkyl group, a substituted alkenyl group or a substituted alkynyl group, and (D) a light fastness stabilizer, which comprises the steps of mixing said near infrared ray-absorbing dye and said light fastness stabilizer with said resin binder to give a master batch, mixing and heating the master batch with said resin binder and said decolorizing agent to give a molten kneaded mixture, and cooling and pulverizing said molten kneaded mixture.

* * * * *